US010085087B2

(12) United States Patent
Katagiri

(10) Patent No.: US 10,085,087 B2
(45) Date of Patent: Sep. 25, 2018

(54) SOUND PICK-UP DEVICE, PROGRAM, AND METHOD

(71) Applicant: Oki Electric Industry Co., Ltd., Tokyo (JP)

(72) Inventor: Kazuhiro Katagiri, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/847,598

(22) Filed: Dec. 19, 2017

(65) Prior Publication Data

US 2018/0242078 A1 Aug. 23, 2018

(30) Foreign Application Priority Data

Feb. 17, 2017 (JP) ..... 2017-028268
Mar. 24, 2017 (JP) ..... 2017-059400

(51) Int. Cl.

| | |
|---|---|
| ***H04R 1/40*** | (2006.01) |
| ***G10L 25/21*** | (2013.01) |
| ***G10L 21/038*** | (2013.01) |
| ***H04R 3/00*** | (2006.01) |

(52) U.S. Cl.
CPC ..... *H04R 1/406* (2013.01); *G10L 21/038* (2013.01); *G10L 25/21* (2013.01); *H04R 3/005* (2013.01)

(58) Field of Classification Search
CPC ..... H04R 1/406; H04R 3/005; G10L 21/038; G10L 25/21
USPC ..... 381/92
See application file for complete search history.

(56) References Cited

U.S. PATENT DOCUMENTS

| | | | | |
|---|---|---|---|---|
| 9,781,508 | B2 * | 10/2017 | Katagiri | H04R 1/406 |
| 2009/0055170 | A1 * | 2/2009 | Nagahama | G10L 15/20 704/226 |
| 2011/0051956 | A1 * | 3/2011 | Jeong | G10L 21/0208 381/94.1 |
| 2013/0343571 | A1 * | 12/2013 | Rayala | H04R 3/005 381/92 |
| 2015/0063590 | A1 * | 3/2015 | Katagiri | H04R 1/406 381/92 |

(Continued)

FOREIGN PATENT DOCUMENTS

| | | |
|---|---|---|
| JP | 2014-072708 A | 4/2014 |
| JP | 2016-127457 A | 7/2016 |
| JP | 2016-127459 A | 7/2016 |

OTHER PUBLICATIONS

"Acoustical Technology Series 16: Array Signal Processing for Acoustics—Localization, Tracking, and Separation of Sound Sources", by Futoshi Asano The Acoustical Society of Japan, published Feb. 25, 2011, Corona Publishing Co. Ltd.

*Primary Examiner* — David Ton
(74) *Attorney, Agent, or Firm* — Rabin & Berdo, P.C.

(57) ABSTRACT

A sound pick-up device of the present disclosure acquires extracted sound as a result of extracting target area sound using non-target area sound present in a target area direction from output of a beam former, divides each of an input signal and the extracted sound into plural bands, computes a power spectrum ratio between the input signal and the extracted sound for each divided band, determines whether or not target area sound is present in the input signal by employing the power spectrum ratios for each divided band, and outputs the extracted sound as a sound pick-up result in cases in which target area sound has been determined to be present.

15 Claims, 13 Drawing Sheets

(56) References Cited

U.S. PATENT DOCUMENTS

2016/0021478 A1* 1/2016 Katagiri ..... H04S 7/30
381/26
2016/0198258 A1* 7/2016 Katagiri ..... H04R 1/406
381/92

* cited by examiner

SUPPRESSION OF NON-TARGET AREA SOUND $N_2$ INCLUDED IN INPUT SIGNAL $X_1$ OF MICROPHONE ARRAY MA1

EXTRACTION OF NON-TARGET AREA SOUND $N_1$ INCLUDED IN OUTPUT $Y_1$ OF MICROPHONE ARRAY MA1

EXTRACTION OF AREA SOUND OUTPUT $Z_1$ INCLUDED IN BF OUTPUT $Y_1$ OF MICROPHONE ARRAY MA1

SOUND PICK-UP DEVICE, PROGRAM, AND METHOD

CROSS-REFERENCE TO RELATED APPLICATION

This application claims priority under 35 USC 119 from Japanese Patent application No. 2017-028268 filed on Feb. 17, 2017, and Japanese Patent application No. 2017-059400 filed on Mar. 24, 2017, the disclosures of which are incorporated by reference herein.

BACKGROUND

Technical Field

The present disclosure relates to a sound pick-up device, program, and method, and may, for example, be applied to processing to emphasize sound from a target area and suppress sound from other areas.

Related Art

Beamformers (referred to below as "BFs") employing a microphone array exist as technology to separate and pick up sounds from only a specific direction in an environment in which plural sound sources are present. BF technology employs a time difference between signals reaching respective microphones to form directionality (see "Acoustic Technology Series 16: Array signal processing for acoustics—Localization, tracking, and separation of sound sources" by Futoshi ASANO, the Acoustical Society of Japan, published Feb. 25, 2011, Corona Publishing Co. Ltd.). BFs can be broadly divided into two types: addition type and subtraction type.

In particular, subtraction-type BFs have the advantage of being able to form directionality using fewer microphones than addition-type BFs.

FIG. 11 is a block diagram illustrating configuration according to a related subtraction-type BF.

The related subtraction-type BF illustrated in FIG. 11 is configured using two microphones.

The related subtraction-type BF first uses a delaying device to compute a time difference between signals arriving at each microphone for a sound present in a target direction (referred to below as a "target sound"), and applies a delay in order to align the phases of the target sound. The delaying device of the related subtraction-type BF computes the time difference using Equation (1) below.

In Equation (1), d is the distance between the microphones, c is the speed of sound, and $\tau_L$ is the delay amount. Moreover, $\theta_L$ in Equation (1) is an angle formed between a direction perpendicular to a straight line connecting between the respective microphones and the target direction.

$$\tau_L=(d \sin \theta_L)/c \tag{1}$$

Here, in cases in which a blind spot is present in a direction further toward a first microphone than a center point between the first microphone and a second microphone, the delaying device of the related subtraction-type BF performs delay processing on an input signal $x_1$ (t) of the first microphone. Then, Equation (2) is used to perform subtraction processing on the input signal $x_1$ (t) that has been subjected to delay processing.

$$a(t)=x_2(t)-x_1(t-\tau_L) \tag{2}$$

The subtraction processing of the related subtraction-type BF can be performed similarly in the frequency domain. In such cases, Equation (2) is modified as in Equation (3) below.

$$A(\omega)=X_2(\omega)-e^{-j\omega\tau_L}X_1(\omega) \tag{3}$$

Here, when $\theta L=\pm\pi/2$, the directionality formed is unidirectional with a cardioid pattern as illustrated in FIG. 12A. When $\theta L=0, \pi$, the directionality formed is bidirectional with a figure-of-8 shape, as illustrated in FIG. 12B. In the following explanation, a filter that forms unidirectionality from an input signal is referred to as a unidirectional filter, and a filter that forms bidirectionality from an input signal is referred to as a bidirectional filter.

Employing spectral subtraction (sometimes referred to below as "SS") enables strong directionality to be formed at a bidirectional blind spot. The directionality formed using SS follows Equation (4). In Equation (4), the input signal $X_1$ of the first microphone is used. However, a similar effect can be obtained with the input signal $X_2$ of the second microphone. Here, β is a coefficient for adjusting the SS strength. In cases in which the value becomes negative after subtraction, flooring processing is performed to replace the negative value with 0 or a value obtained by reducing the original value. This method enables sound present outside of the target direction (also referred to below as "non-target sound") to be extracted using the bidirectionality filter, and a power spectrum of the extracted non-target sound is subtracted from a power spectrum of the input signal, thus enabling the target sound to be emphasized.

$$|Y(\omega)|=|X_1(\omega)|-\beta|A(\omega)| \tag{4}$$

In cases in which it is desirable to pick up only sound present in a specific area (referred to below as "target area sound"), if subtraction-type BF is employed alone, it is possible that sound sources present in the vicinity of the area (referred to below as "non-target area sound") might also be picked up. Japanese Patent Application Laid-Open (JP-A) No. 2014-072708 proposes a method to pick up target area sound by employing plural microphone arrays to aim directionality at the target area from different directions, such that the directionalities intersect in the target area.

Next, explanation follows regarding an example of sound pick-up processing for target area sound, as described in JP-A No. 2014-072708.

FIG. 13 is an explanatory diagram illustrating a configuration example of respective microphone arrays in a case in which two microphone arrays MA1, MA2 are employed to pick up target area sound from a sound source in a target area.

FIG. 14 are explanatory diagrams (graphs) illustrating frequency regions in BF output of the respective microphone arrays MA1, MA2 illustrated in FIG. 13. FIG. 14A and FIG. 14B are graphs (illustrations) illustrating frequency regions in the BF output of the respective microphone arrays MA1, MA2.

In the method described in JP-A No. 2014-072708, first, a ratio of power of the target area sound included in the BF output of the respective microphone arrays MA1, MA2 is estimated, and this is taken as a correction coefficient. Specifically, in cases in which two microphone arrays MA1, MA2 are employed, the correction coefficient for the target area sound power may, for example, be computed using Equations (5) and (6), or using Equations (7) and (8).

$$\alpha(n) = \text{mode}\left(\frac{Y_{1k}(n)}{Y_{2k}(n)}\right) \; k = 1, 2, \ldots, N \tag{5}$$

$$\alpha(n) = \text{median}\left(\frac{Y_{1k}(n)}{Y_{2k}(n)}\right) \; k = 1, 2, \ldots, N \tag{6}$$

Here, $Y_{1k}(n)$, $Y_{2k}(n)$ are power spectra in the BF output of the microphone arrays MA1, MA2. N is the total number of frequency bins, k is frequency, and $\alpha(n)$ is the power correction coefficient for the BF output. mode represents the mode, and median represents the median. Each BF output is then corrected using the correction coefficient, and SS is performed in order to extract non-target area sound present in the target area direction. Further, spectral subtracting the extracted non-target area sound from the output of each BF enables target area sound to be extracted.

FIG. 15 are explanatory diagrams (illustrations) illustrating changes in the power spectra of respective components in a case in which area sound pick-up processing is performed based on the BF output acquired using the microphone arrays MA1, MA2 illustrated in FIG. 13.

First, in the input signal $X_1$ of the microphone array MA1, non-target area sound $N_2$ is suppressed to obtain a BF output $Y_1$ (see FIG. 15A).

In order to extract non-target area sound $N_1$ (n) present in the target area direction from the perspective of the microphone array MA1, as shown in Equation (7), a value obtained by multiplying the BF output $Y_2$ (n) from the microphone array MA2 by the power correction coefficient $\alpha$ is spectral subtracted from the BF output $Y_1$ (n) from the microphone array MA1 (see FIG. 15B). Then, following Equation (8), non-target area sound is spectral subtracted from each BF output to extract target area sound (see FIG. 15C). $\gamma$ (n) is a coefficient for changing the strength in SS.

$$N_1(n)=Y_1(n)-\alpha(n)Y_2(n) \tag{7}$$

$$Z_1(n)=Y_1(n)-\gamma(n)N_1(n) \tag{8}$$

In order to extract target area sound, SS, this being non-linear processing, is performed using Equation (4) and Equation (8). Accordingly, there is a possibility of unpleasant noise, referred to as musical noise, arising in high noise environments.

Accordingly, in JP-A No. 2016-127457, segments in which target area sound is present and segments in which target area sound is not present are identified, and sound that has been subjected to area sound pick-up processing is not output for segments in which target area sound is not present, thereby suppressing noise such as musical noise. In order to determine whether or not target area sound is present, first, a power spectrum ratio (area sound output/input signal) between input signals and output of extracted target area sound (referred to below as "area sound output") is computed according to Equation (9). In cases in which a sound source is present in the target area, the input signal $X_1$ and the area sound output $Z_1$ both include target area sound, and therefore the power spectrum ratio of a target area sound component is a value close to 1. Conversely, non-target area sound components are suppressed in the area sound output, and therefore have a small power spectrum ratio value. Moreover, since SS is performed plural times during area sound pick-up processing, other background noise components are also suppressed to some degree even without performing dedicated noise suppression processing in advance, thereby giving a small power spectrum ratio value. Conversely, in cases in which target area sound is not present, in contrast to the input signal, the area sound output includes only weakened noise that remains after removal, and therefore the entire region exhibits small power spectrum ratio values. Due to having this characteristic, obtaining an average power spectrum ratio found for all frequencies using Equation (10) (referred to below as the "average power spectrum ratio") results in a large difference between cases in which target area sound is present and cases in which target area sound is not present. Note that m and n are respectively the upper limit and lower limit of the bands subject to processing, and may, for example, be respectively set to 100 Hz and 6 kHz, between which audio information is sufficiently contained. Moreover, in the device described in JP-A No. 2016-127457, the average power spectrum ratios are assessed using a preset threshold value. In cases in which determination is made that target area sound is not present, the area sound output data is not output, and silence, or sound in which the gain of the input sound has been reduced, is output.

$$R = \frac{Z_1}{X_1} \tag{9}$$

$$U = \frac{1}{n-m}\sum_{k=m}^{n} R_{1k} \tag{10}$$

The method described in JP-A No. 2014-072708 enables target area sound to be picked up even if non-target area sound is present in the vicinity of the target area. Moreover, the method described in JP-A No. 2016-127457 enables the effect of musical noise generated during area sound pick-up processing to be suppressed. However, the SN ratio worsens in high noise environments, such as locations where a large number of people are present, such as event venues, or in locations in which music or the like is playing nearby, and it is possible that the power spectrum of sound output by the area sound pick-up could become small. In such circumstances, the average power spectrum ratio of the area sound pick-up output and the input signals becomes small. In particular, in components having a small power spectrum, such as unvoiced consonants, the difference between the average power spectrum ratios for non-target area sound segments becomes small, and there is a possibility that the determination precision of target area sound might become poor, resulting in some target area sound being lost.

A sound pick-up device, program, method, and determination device, program, and method capable of improving determination precision of target area sound in environments with strong background noise are desired.

SUMMARY

A sound pick-up device of a first aspect of the present disclosure includes (1) a directionality forming unit that forms directionality in a target area direction from an input signal using a beam former, (2) a non-target area sound extraction unit that extracts non-target area sound present in the target area direction designated by the directionality formed by the directionality forming unit, (3) a target area sound extraction unit that outputs extracted sound, the extracted sound obtained by subtracting the non-target area sound present in the target area direction from output of the beam former, (4) a band dividing unit that divides each of the input signal and the extracted sound into plural bands, (5) a power spectrum ratio computation unit that computes a power spectrum ratio between the input signal and the extracted sound for each divided band divided by the band dividing unit, (6) a determination unit that determines whether or not target area sound is present in the input signal by employing the power spectrum ratio for each divided band computed by the power spectrum ratio computation unit, and (7) an output unit that outputs the extracted sound as a sound pick-up result in cases in which the determination unit has determined target area sound to be present.

A non-transitory computer-readable recording medium of a second aspect of the present disclosure stores a sound pick-up program that causes a computer to execute processing, the processing including (1) forming directionality in a target area direction from an input signal using a beam former, (2) extracting non-target area sound present in the target area direction designated by the formed directionality, (3) outputting extracted sound, the extracted sound obtained by subtracting the extracted non-target area sound present in the target area direction from output of the beam former, (4) dividing each of the input signal and the extracted sound into plural bands, (5) computing a power spectrum ratio between the input signal and the extracted sound for each divided band, (6) determining whether or not target area sound is present in the input signal by employing the power spectrum ratio computed for each divided band, and (7) outputting the extracted sound as a sound pick-up result in cases in which target area sound has been determined to be present.

A sound pick-up method of a third aspect of the present disclosure includes (1) forming directionality in a target area direction from an input signal using a beam former, (2) extracting non-target area sound present in the target area direction designated by the formed directionality, (3) outputting extracted sound, the extracted sound obtained by subtracting the extracted non-target area sound present in the target area direction from output of the beam former, (4) dividing each of the input signal and the extracted sound into plural bands, (5) computing a power spectrum ratio between the input signal and the extracted sound for each divided band, (6) determining whether or not target area sound is present in the input signal by employing the power spectrum ratio computed for each divided band, and (7) outputting the extracted sound as a sound pick-up result in cases in which target area sound has been determined to be present.

A sound pick-up device of a fourth aspect of the present disclosure includes (1) a directionality forming unit that forms directionality in a target area direction from an input signal using a beam former, (2) a non-target area sound extraction unit that extracts non-target area sound present in the target area direction designated by the directionality formed by the directionality forming unit, (3) a target area sound extraction unit that outputs extracted sound, the extracted sound obtained by subtracting the non-target area sound present in the target area direction from output of the beam former, (4) a power spectrum ratio computation unit that computes a power spectrum ratio between the input signal and the extracted sound for each frequency component, (5) a determination unit that determines whether or not target area sound is present in each frequency component by employing the power spectrum ratio computed by the power spectrum ratio computation unit, and (6) an output unit that outputs a frequency component of the extracted sound for a frequency component in which the determination unit has determined target area sound to be present.

A non-transitory computer-readable recording medium of a fifth aspect of the present disclosure stores a sound pick-up program that causes a computer to execute processing, the processing including (1) forming directionality in a target area direction from an input signal using a beam former, (2) extracting non-target area sound present in the target area direction designated by the formed directionality, (3) outputting extracted sound, the extracted sound obtained by subtracting the extracted non-target area sound present in the target area direction from output of the beam former, (4) computing a power spectrum ratio between the input signal and the extracted sound for each frequency component, (5) determining whether or not target area sound is present for each frequency component by employing the computed power spectrum ratios, and (6) outputting a frequency component of the extracted sound for a frequency component in which target area sound has been determined to be present.

A sound pick-up method of a sixth aspect of the present disclosure includes (1) forming directionality from a target area direction in an input signal using a beam former, (2) extracting non-target area sound present in the target area direction designated by the formed directionality, (3) outputting extracted sound, the extracted sound obtained by subtracting the extracted non-target area sound present in the target area direction from output of the beam former, (4) computing a power spectrum ratio between the input signal and the extracted sound for each frequency component, (5) determining whether or not target area sound is present for each frequency component by employing the computed power spectrum ratios, and (6) outputting a frequency component of the extracted sound for a frequency component in which target area sound has been determined to be present.

The present disclosure is capable of improving determination precision of target area sound in environments with strong background noise.

BRIEF DESCRIPTION OF THE DRAWINGS

Exemplary embodiments of the present disclosure will be described in detail based on the following figures, wherein.

DETAILED DESCRIPTION

(A) First Exemplary Embodiment

Detailed explanation follows regarding a sound pick-up device, program, and method, and a determination device, program, and method of a first exemplary embodiment of the present disclosure, with reference to the drawings.

(A-1) Configuration of First Exemplary Embodiment

Figure 1:
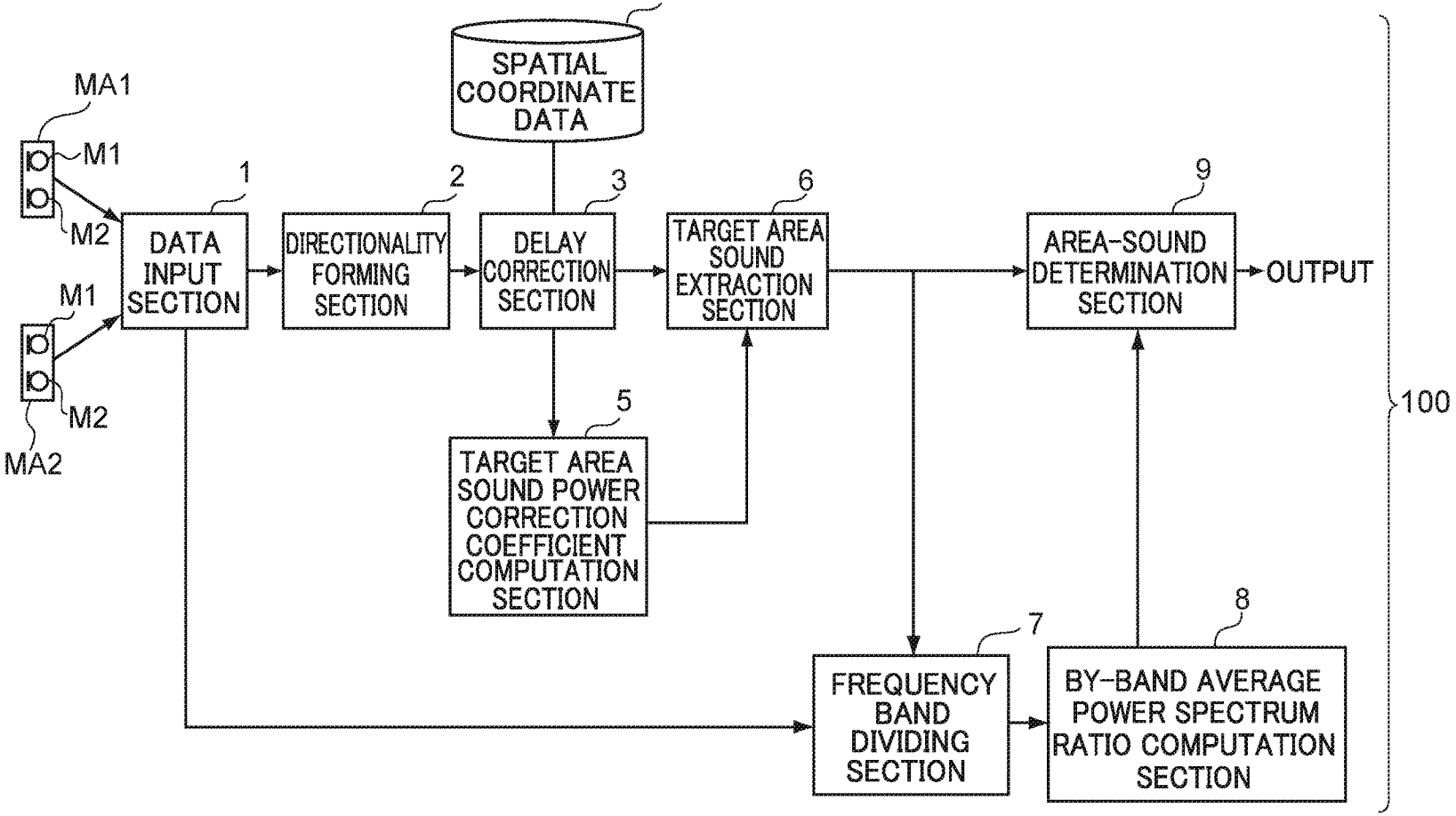
FIG. 1 is a block diagram illustrating functional configuration of a sound pick-up device (determination device) according to a first exemplary embodiment.

FIG. 1 is a block diagram illustrating functional configuration of a sound pick-up device 100 of the first exemplary embodiment.

The sound pick-up device 100 employs two microphone arrays MA (MA1, MA2) to perform target area sound pick-up processing to pick up target area sound from a sound source in a target area.

Figure 13:
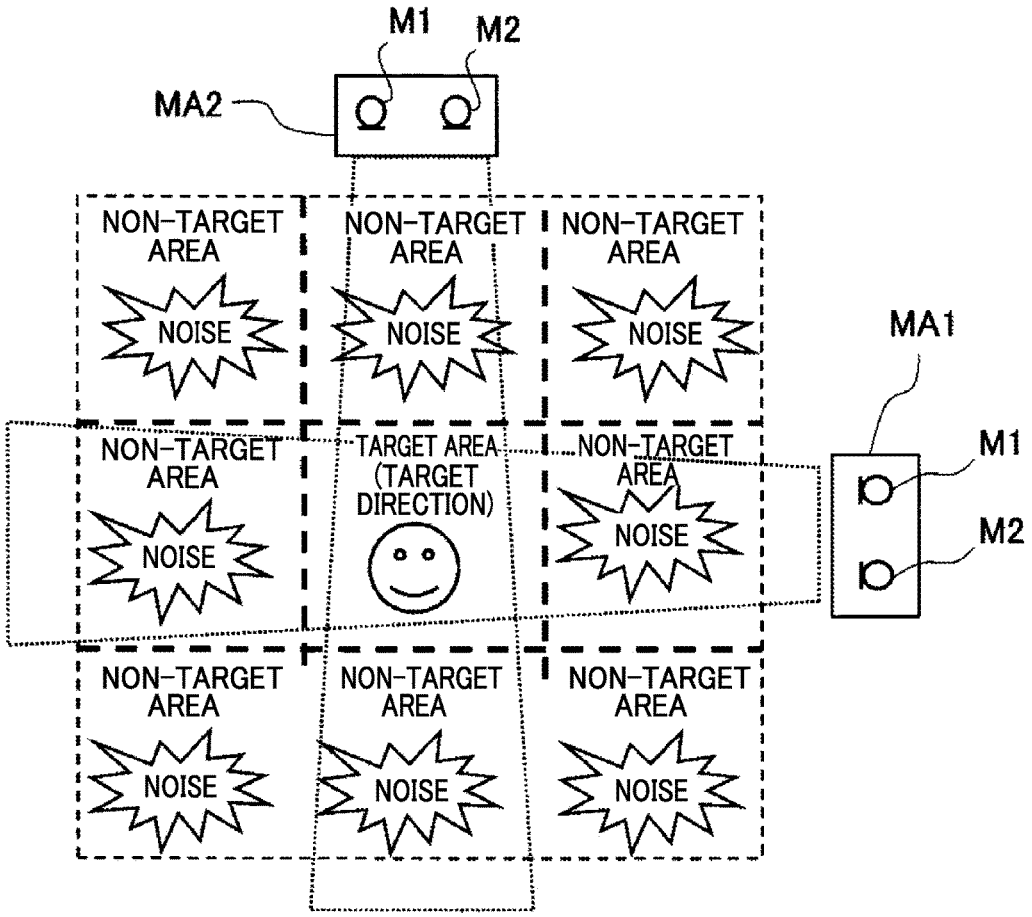
FIG. 13 is an explanatory diagram illustrating a configuration example of respective microphone arrays in a case in which two related microphone arrays are employed to pick up target area sound from a sound source in a target area.
Figure 14A:
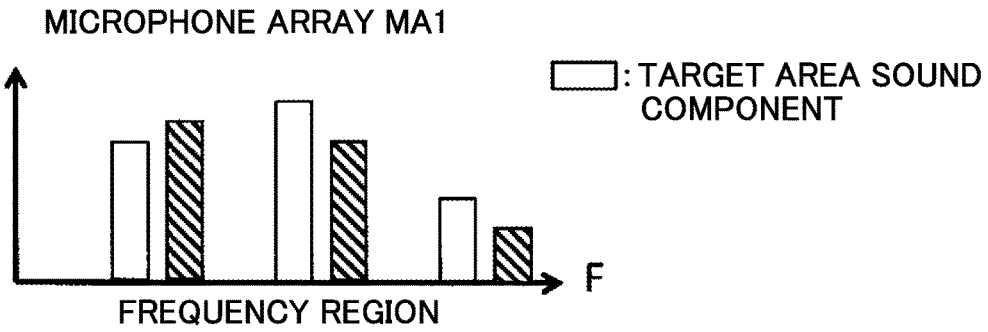
FIG. 14A and FIG. 14B are explanatory diagrams illustrating respective BF output of two related microphone arrays by frequency regions.
Figure 14B:
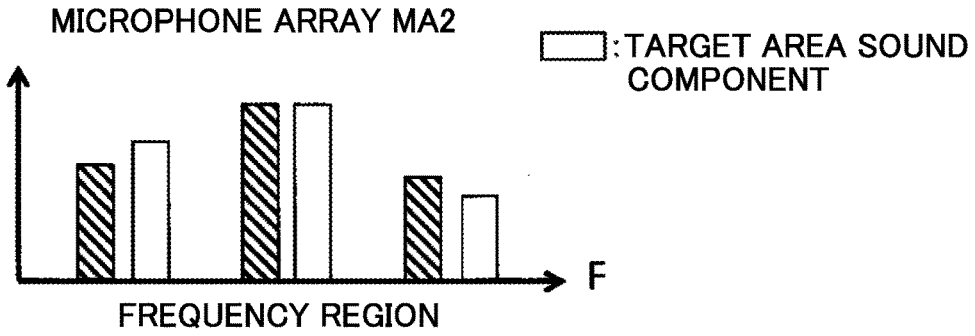
Figure 15A:
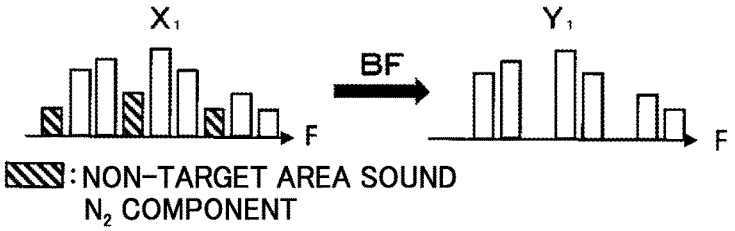
FIG. 15A to FIG. 15C are explanatory diagrams illustrating changes in the power spectra of respective components in a case in which area sound pick-up processing is performed based on BF output acquired using two related microphone arrays.
Figure 15B:
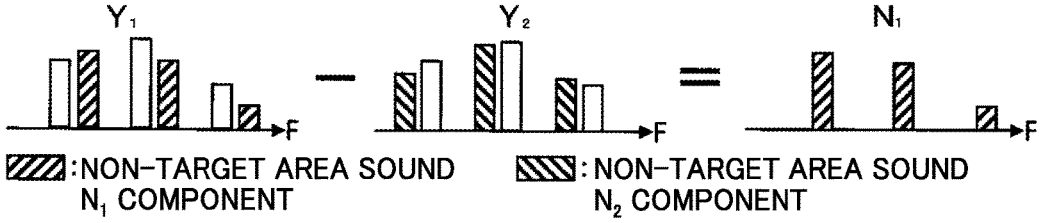
Figure 15C:
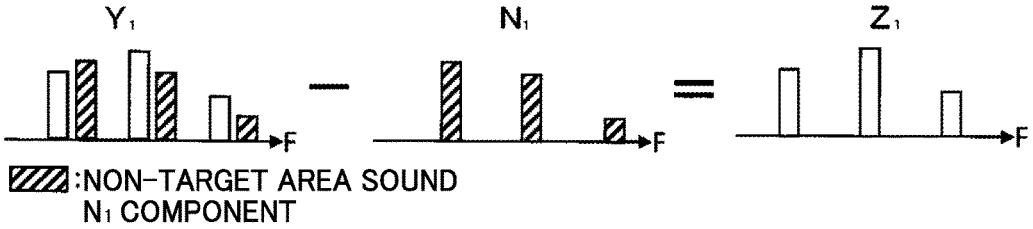

The microphone arrays MA1, MA2 are disposed at any desired location in a space in which a target area is present. As illustrated in FIG. 13, for example, the microphone arrays MA1, MA2 may be positioned anywhere with respect to the target area as long as their directionality overlaps in the target area. For example, the microphone arrays MA1, MA2 may be disposed facing each other across the target area. Each microphone array MA is configured by two or more microphones M, and each microphone M picks up acoustic signals. In the present exemplary embodiment, explanation is given in which two microphones M (M1, M2) that pick up acoustic signals are disposed in each microphone array MA. Namely, each microphone array MA is configured by a 2ch microphone array. Note that the number of the microphone arrays MA is not limited to two. In cases in which plural target areas are present, it is necessary to dispose a sufficient number of microphone arrays MA to cover all of the areas.

The sound pick-up device 100 includes a data input section 1, a directionality forming section 2, a delay correction section 3, spatial coordinate data 4, a target area sound power correction coefficient computation section 5, a target area sound extraction section 6, a frequency band dividing section 7, a by-band average power spectrum ratio computation section 8, and an area-sound determination section 9. Explanation regarding detailed processing of each functional block configuring the sound pick-up device 100 will be given later.

Note that in the present exemplary embodiment, explanation is given in which the sound pick-up device 100 outputs target area sound pick-up results based on the result of processing to determine whether or not target area sound is present in an input signal. However, configuration may be made in which an output unit that outputs target area sound pick-up results (part of the processing of the area-sound determination section 9) is omitted from the sound pick-up device 100, and the sound pick-up device 100 is configured as a determination device (determination program, determination method) that outputs determination processing results for the target area sound.

The sound pick-up device 100 may be configured entirely by hardware (for example, dedicated chips or the like), or may be partially or entirely configured by software (programs). For example, the sound pick-up device 100 may be configured by installing programs (including a determination program and a sound pick-up program of the present exemplary embodiment) in a computer that includes a processor and memory.

(A-2) Operation of the First Exemplary Embodiment

Next, explanation follows regarding operation (a determination method and a sound pick-up method according to an exemplary embodiment) of the sound pick-up device 100 of the first exemplary embodiment configured as described above.

The data input section 1 converts acoustic signals picked up by the microphone arrays MA1, MA2 from analog signals into digital signals. The data input section 1 then subjects the digital signals to conversion processing (for example, processing employing fast Fourier Transform or the like to convert from the time domain to the frequency domain).

For each microphone array MA, the directionality forming section 2 extracts non-target area sound present outside of a target direction (for example, by extraction using a bidirectional filter), and subtracts an amplitude spectrum of the extracted non-target area sound from the amplitude spectrum of the input signal in order to acquire sound (BF output) formed with directionality in a target area direction. Specifically, for each microphone array MA, the directionality forming section 2 uses BF according to Equation (4) in order to acquire sound formed with directionality in the target area direction as the BF output. Note that configuration may be made such that in cases in which the input signals are signals input from a directional microphone rather than a microphone array MA, the processing of the directionality forming section 2 is omitted, and at a later stage, the input signals are supplied as they are.

The delay correction section 3 computes and corrects a delay arising due to differences in the distance of the respective microphone arrays MA (MA1, MA2) from the target area. The delay correction section 3 acquires the position of the target area and the positions of the microphone arrays from the spatial coordinate data 4, and computes the difference between the time taken for target area sound to arrive at the respective microphone arrays MA (MA1, MA2). Next, using the microphone array MA (MA1, MA2) disposed at the position furthest from the target area as a reference, the delay correction section 3 applies delays such that the target area sound reaches all of the microphone arrays MA (MA1, MA2) at the same time.

The spatial coordinate data 4 retains position information for all target areas, the microphone arrays MA (MA1, MA2), and the microphones M (M1, M2) configuring each of the microphone arrays MA (MA1, MA2).

The target area sound power correction coefficient computation section 5 computes a correction coefficient according to Equation (5) or Equation (6) to make the power of a target area sound component included in the output from each BF the same.

The target area sound extraction section 6 performs SS according to Equation (7) for output data of each BF output data after correction using the correction coefficient computed by the target area sound power correction coefficient computation section 5 to extract noise present in the target area direction. The target area sound extraction section 6 then extracts target area sound by spectral subtracting the extracted noise from the output of each BF according to Equation (8).

The frequency band dividing section 7 acquires an input signal from the data input section 1 and an area sound output $Z_1$ from the target area sound extraction section 6, and divides each into plural bands. Here, the input signal and the area sound output are assumed to have the same bandwidth.

In the following explanation, an input signal $X_1$ from the microphone array MA1 is employed as a representative of a processing target input signal of the frequency band dividing section 7 and the by-band average power spectrum ratio computation section 8. However, this may be substituted for input signals from the other microphones (these may be microphones of other microphone arrays MA).

The frequency band dividing section 7, for example, divides the processing target signals (the input signal $X_1$ and the area sound output $Z_1$) into predetermined frequency bandwidths (uniform intervals or non-uniform intervals). In the following explanation, the plural frequency bands into which the processing target signals are divided by the frequency band dividing section 7 are referred to as "divided bands", and signals of each divided band (signals divided from the division target signal) are referred to as "divided band signals".

The frequency band dividing section 7 may set each divided band with equal bandwidths (equal intervals), or may bias the frequency band setting. For example, the frequency band dividing section 7 may set wider divided bands the higher the frequency (set narrower divided bands the lower the frequency). For example, the frequency band dividing section 7 may set low frequency bands (for example, less than 1 kHz) to have divided bands at 100 Hz intervals, and set bands that are not low frequency (for example 1 kHz or greater) to have divided bands at 1 kHz intervals.

Moreover, the frequency band dividing section 7 may set the divided bands in a band of a predetermined range in which audio information (an audio component) is sufficiently contained (for example a range of from 100 hz to 6 kHz), with signals outside of this frequency band being discarded (cut off as outside the band division target).

In the example of the present exemplary embodiment, for ease of explanation, in the following explanation, the frequency band dividing section 7 divides processing target signals into divided bands at 1 kHz intervals.

Figure 2:
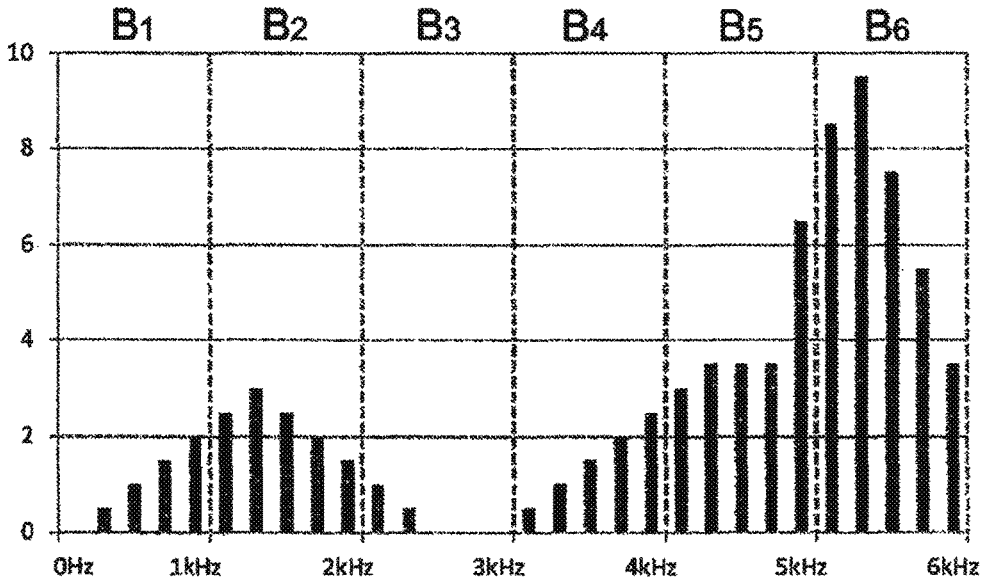
FIG. 2 is a diagram (graph) illustrating an example of a power spectrum of a processing target signal that has been divided into divided bands by a frequency band dividing section according to the first exemplary embodiment.

FIG. 2 illustrates an example of a processing target signal that has been processed by the frequency band dividing section 7 (a graph illustrating power spectra for each band). FIG. 2 illustrates an example in which the frequency band dividing section 7 divides a processing target signal in a band from 100 Hz to 6 kHz into six divided bands $B_1$ to $B_6$ at approximately 1 kHz intervals.

The by-band average power spectrum ratio computation section 8 extracts (acquires) power spectra for each divided band (divided band signal) divided by the frequency band dividing section 7 for each processing target signal (the input signal $X_1$ and the area sound output $Z_1$). Moreover, for each divided band, the by-band average power spectrum ratio computation section 8 computes an average power spectrum ratio (average of the power spectrum ratio in each divided band) based on Equation (11) described below.

In Equation (11), $R_j$ is the average power spectrum ratio of the $j^{th}$ divided band (j being any integer from 1 to M; M being the total number of divided bands (number of individual divided bands)). Moreover, in Equation (11), $X_{1j}$ is the average power spectrum (average value of the power spectrum) within the $j^{th}$ divided band of the input signal $X_1$ of the microphone array MA1. $Z_{1j}$ is the average power spectrum (average value of the power spectrum) within the $j^{th}$ divided band of the area sound output $Z_1$.

For example, a case is envisaged in which the frequency band dividing section 7 divides each processing target signal (the input signal $X_1$ and the area sound output $Z_1$) into six divided bands $B_1$ to $B_6$, as illustrated in FIG. 2. In such cases, the by-band average power spectrum ratio computation section 8 acquires average power spectra $X_{11}$ to $X_{16}$ for the respective input signals from the divided bands $B_1$ to $B_6$ of the input signal $X_1$. The by-band average power spectrum ratio computation section 8 further acquires average power spectra $Z_{11}$ to $Z_{16}$ for the respective area sound outputs from the divided bands $B_1$ to $B_6$ of the area sound output $Z_1$.

Moreover, the by-band average power spectrum ratio computation section 8 computes average power spectrum ratios $R_1$ to $R_6$ for each divided band by applying $X_{11}$ to $X_{16}$ and $Z_{11}$ to $Z_{16}$ to Equation (11).

Figure 3:
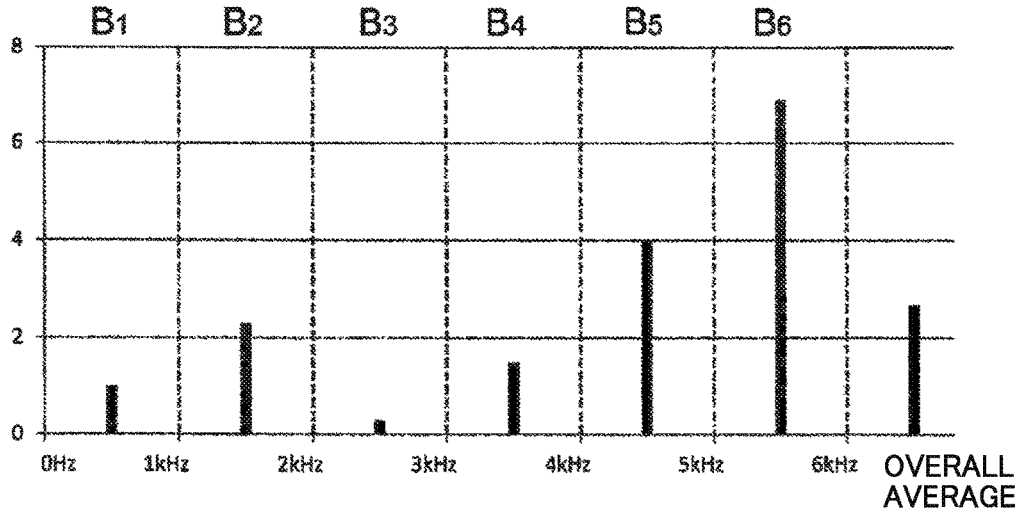
FIG. 3 is a diagram (graph) illustrating average power spectrum ratios for each divided band computed by a by-band average power spectrum ratio computation section according to the first exemplary embodiment.

FIG. 3 is a diagram (graph) illustrating the average power spectrum ratios $R_1$ to $R_6$ for each divided band computed by the by-band average power spectrum ratio computation section 8.

FIG. 3 illustrates the average power spectrum ratios $R_1$ to $R_6$ for each divided band and the average power spectrum across all bands (the value on the far right).

According to Equation (12), the by-band average power spectrum ratio computation section 8 also acquires the maximum value (average power spectrum ratio) from the average power spectrum ratios $R_1$ to $R_6$ for each divided band as a maximum average power spectrum ratio $U_{max}$.

For example, in a case in which the values of the average power spectrum ratios $R_1$ to $R_6$ for each divided band give the result shown in FIG. 3, it can be seen that the maximum average power spectrum ratio $U_{max}$ is the value of divided band $B_6$, this being a greater value than the average power spectrum across all bands.

$$R_j = \frac{Z_{1j}}{X_{1j}} (j = 1, \ldots, M) \tag{11}$$

$$U_{max} = \max \overline{R_j} \tag{12}$$

The area-sound determination section 9 compares the maximum average power spectrum ratio $U_{max}$ computed by the by-band average power spectrum ratio computation section 8 against a preset threshold value T1 to determine whether or not target area sound is present (whether or not the input signal includes target area sound). For example, the area-sound determination section 9 may determine target area sound to be present in cases in which the maximum average power spectrum ratio $U_{max}$ exceeds the threshold value T1, and determine target area sound not to be present in cases in which the maximum average power spectrum ratio $U_{max}$ is the threshold value T1 or lower.

In cases in which target area sound has been determined to be present, the area-sound determination section 9 may output area sound pick-up processing data (the area sound output $Z_1$ (extracted sound)) as-is. Conversely, however, in cases in which target area sound has been determined not to be present, the area-sound determination section 9 may output silent audio data without outputting area sound pick-up processing data (the area sound output $Z_1$ (extracted sound)). Note that instead of silent audio data, the area-sound determination section 9 may output the input signal (for example, the input signal $X_1$ of the microphone array MA1) with weakened gain.

In the sound pick-up device 100 of the first exemplary embodiment, the input signal ($X_1$ in the above example) and the area sound output $Z_1$ are divided into plural divided bands, and the average power spectrum ratios are found for each divided band. Whether or not target area sound is present is determined based on the maximum average power spectrum ratio $U_{max}$, this being the maximum value out of the average power spectrum ratios.

In other words, in the sound pick-up device 100 of the first exemplary embodiment, target area sound is determined to be present if there is even one divided band in which the average power spectrum ratio exceeds a threshold value (T1 in the example described above). In cases in which the target area sound is human speech, although unvoiced consonants are low in power, there is still a peak in the power spectrum, and therefore by dividing the bands, the power of the band including the peak becomes greater. Since characteristics such as this exist, when the maximum value out of the average power spectrum ratio for each divided band (the maximum average power spectrum ratio $U_{max}$) is compared against the average power spectrum ratio across all bands, the difference becomes clear (for example, the difference between a non-target area sound segment in which noise such as musical noise is being generated, and a target area sound segment). Accordingly, in comparison to related target area sound determination employing average power spectrum ratios or the like across all bands, the sound pick-up device 100 of the first exemplary embodiment is capable of improving the determination precision of target area sound in an environment with strong background noise.

Moreover, in the first exemplary embodiment, target area sound is determined using the maximum value out of the average power spectrum ratios for each divided band (maximum average power spectrum ratio $U_{max}$). Accordingly, determination processing can be performed stably, with little influence from burst-type noise, since determination is not performed using only a single sample, while still localizing the band employed for target area sound determination to a peak and its surroundings.

(B) Second Exemplary Embodiment

Detailed explanation follows regarding a sound pick-up device, program, and method, and a determination device, program, and method, of a second exemplary embodiment of the present disclosure, with reference to the drawings.

(B-1) Configuration of Second Exemplary Embodiment

Figure 4:
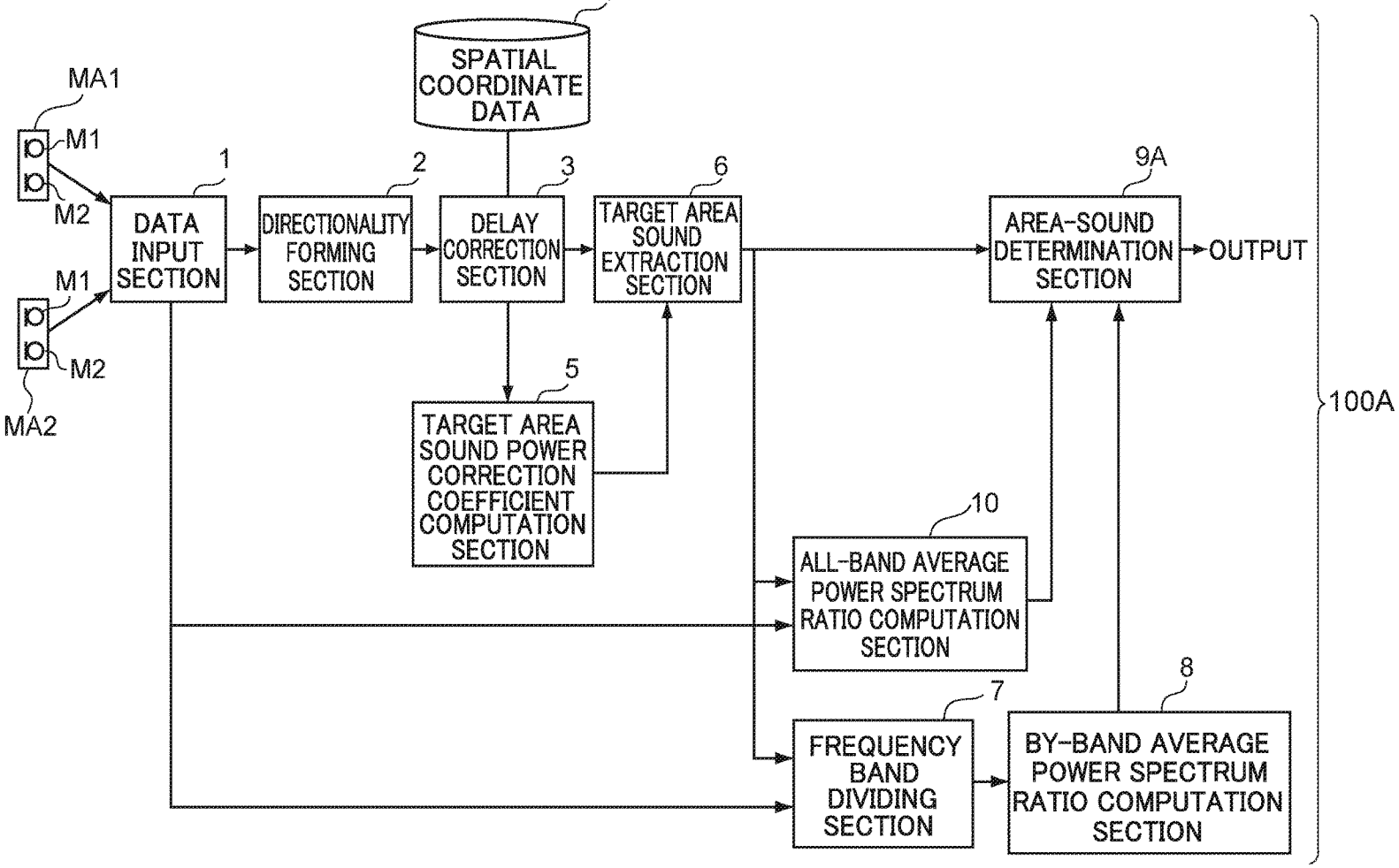
FIG. 4 is a block diagram illustrating functional configuration of a sound pick-up device (determination device) according to a second exemplary embodiment.

FIG. 4 is a block diagram illustrating functional configuration of a sound pick-up device 100A of the second exemplary embodiment. In FIG. 4, sections that are the same as or correspond to those in FIG. 1 described above are allocated the same reference numerals or corresponding reference numerals.

Explanation follows regarding differences between the sound pick-up device 100A of the second exemplary embodiment and the first exemplary embodiment.

The sound pick-up device 100A differs from the first exemplary embodiment in the points that an area-sound determination section 9A is provided instead of the area-sound determination section 9, and an all-band average power spectrum ratio computation section 10 is additionally provided.

The all-band average power spectrum ratio computation section 10 computes the average power spectrum ratio across all bands.

The area-sound determination section 9A controls the frequency band dividing section 7, the by-band average power spectrum ratio computation section 8, and the all-band average power spectrum ratio computation section 10 to determine whether or not target area sound is present.

(B-2) Operation of Second Exemplary Embodiment

Next, explanation follows regarding differences between operation of the sound pick-up device 100A of the second exemplary embodiment configured as described above (a determination method and sound pick-up method according to an exemplary embodiment) and the first exemplary embodiment.

In the sound pick-up device 100A, the target area sound determination processing by the area-sound determination section 9A differs from that of the first exemplary embodiment. Explanation follows regarding target area sound determination processing, focusing on the area-sound determination section 9A.

Figure 5:
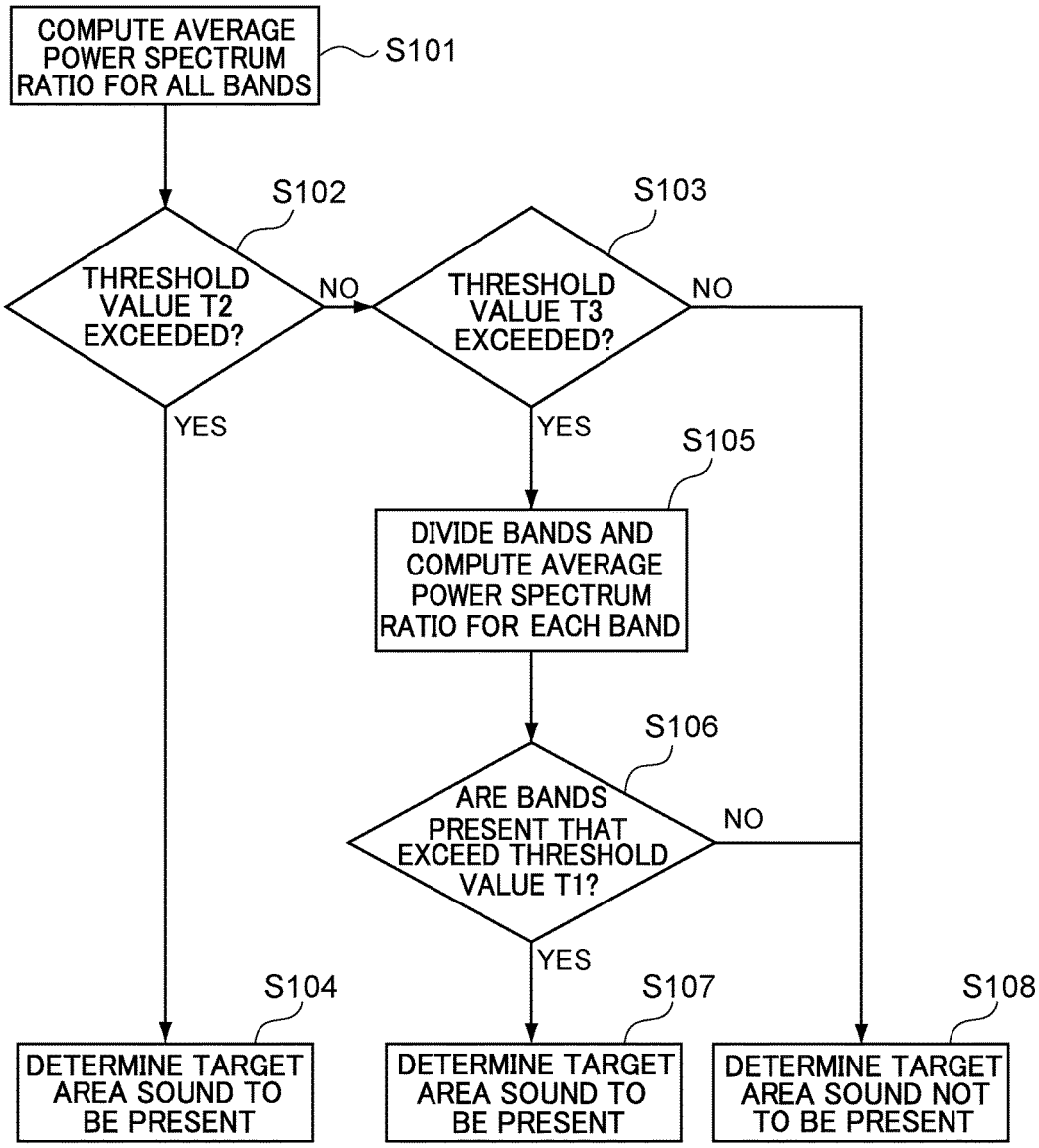
FIG. 5 is a flowchart illustrating target area sound determination processing operation of a sound pick-up device (determination device) according the second exemplary embodiment.

FIG. 5 is a flowchart illustrating target area sound determination processing by the sound pick-up device 100A (area-sound determination section 9A).

In the flowchart of FIG. 5, T1, T2, and T3 are threshold values used in area-sound determination processing. A similar threshold value to that of the first exemplary embodiment may be applied as the threshold value T1. The threshold value T2 is a value greater than the threshold value T3 (T2>T3). There is no limitation regarding the magnitude relationship between T1, and T2 and T3, and a suitable value confirmed through testing or the like may be applied.

First, the area-sound determination section 9A controls the all-band average power spectrum ratio computation section 10 to compute an all-band average power spectrum ratio (S101).

The all-band average power spectrum ratio computation section 10 computes the all-band average power spectrum ratio according to Equation (9) and Equation (10).

Next, the area-sound determination section 9A determines whether or not the all-band average power spectrum ratio computed by the all-band average power spectrum ratio computation section 10 exceeds the threshold value T2 (whether or not U>T2) (S102). The area-sound determination section 9A performs operation from step S104, described later, in cases in which the all-band average power spectrum ratio exceeds the threshold value T2, and performs operation from step S103, described later, in all other cases.

In cases in which the all-band average power spectrum ratio exceeds the threshold value T2 (cases in which U>T2), the area-sound determination section 9A determines target area sound to be present (S104), and ends target area sound determination processing.

On the other hand, in cases in which the all-band average power spectrum ratio is the threshold value T2 or lower (cases in which U<T2), the area-sound determination section 9A then determines whether or not the all-band average power spectrum ratio exceeds the threshold value T3 (whether or not U>T3) (S103). The area-sound determination section 9A performs operation from step S105, described later, in cases in which the all-band average power spectrum ratio exceeds the threshold value T3, and performs operation starting from step S108, described later, in all other cases.

In cases in which the all-band average power spectrum ratio exceeds the threshold value T3 (cases in which U>T3), the area-sound determination section 9A controls the frequency band dividing section 7 and the by-band average power spectrum ratio computation section 8 and performs processing similar to that of the first exemplary embodiment to compute average power spectrum ratios for each divided band (S105).

Next, similarly to in the first exemplary embodiment, the area-sound determination section 9A controls the by-band average power spectrum ratio computation section 8 to compute the maximum average power spectrum ratio $U_{max}$ out of the average power spectrum ratios for each divided band, and determines whether or not the maximum average power spectrum ratio $U_{max}$ exceeds the threshold value T1 (S106). In other words, the area-sound determination section 9A and the by-band average power spectrum ratio computation section 8 perform processing to determine whether or not an average power spectrum ratio exceeding the threshold value T1 is present amongst the average power spectrum ratios for each divided band.

In cases in which the maximum average power spectrum ratio $U_{max}$ exceeds the threshold value T1 (in cases in which an average power spectrum ratio exceeding the threshold value T1 is present among the average power spectrum ratio for each divided band), the area-sound determination section 9A performs operation from step S107, described later, and in all other cases, performs operation from step S108, described later.

In cases in which the maximum average power spectrum ratio $U_{max}$ exceeds the threshold value T1 (in cases in which Umax>T1), the area-sound determination section 9A determines target area sound to be present (S107), and ends the target area sound determination processing.

On the other hand, in cases in which the all-band average power spectrum ratio is the threshold value T3 or lower at step S103 described above (cases in which U<T3), or cases in which the maximum average power spectrum ratio $U_{max}$ is the threshold value T1 or lower at step S106 (cases in which $U_{max}$≤T1), described above, the area-sound determination section 9A determines target area sound not to be present (S108), and ends the target area sound determination processing.

The area-sound determination section 9A first causes the all-band average power spectrum ratio computation section 10 to compute the all-band average power spectrum ratio, and then performs target area sound determination processing (referred to below as "first determination processing") based on the all-band average power spectrum ratio. Specifically, as described above, the area-sound determination section 9A determines target area sound to be present in cases in which the all-band average power spectrum ratio is greater than the threshold value T2, and determines target area sound not to be present in cases in which the all-band average power spectrum ratio is the threshold value T3 or lower.

Moreover, in cases in which the all-band average power spectrum ratio is the threshold value T2 or lower and exceeds the threshold value T3 (T2≤U>T3), the area-sound determination section 9A determines that target area sound cannot be determined using the first determination processing, and controls the frequency band dividing section 7 and the by-band average power spectrum ratio computation section 8 to perform processing similar to that of the first exemplary embodiment to compute the maximum average power spectrum ratio $U_{max}$, and then perform processing to determine whether or not target area sound is present based on the maximum average power spectrum ratio $U_{max}$ (referred to below as "second determination processing").

The sound pick-up device 100A (area-sound determination section 9A) of the second exemplary embodiment performs target area sound determination processing (first determination processing) based on the all-band average power spectrum ratio first, and in cases in which the all-band average power spectrum ratio is the threshold value T2 or lower and exceeds the threshold value T3 (T2≤U>T3), then performs target area sound determination processing (second determination processing) based on the maximum average power spectrum ratio $U_{max}$.

Accordingly, in cases in which sufficiently precise target area sound determination processing is possible using the first determination processing (determination processing based on the all-band average power spectrum ratio) alone (for example, cases in which the all-band average power spectrum ratio is sufficiently large), the sound pick-up device 100A (area-sound determination section 9A) does not perform the second determination processing (band division processing and the like). On the other hand, the sound pick-up device 100A (the area-sound determination section 9A) performs the second determination processing (processing to divide bands and determine target area sound by computing the maximum average power spectrum ratio $U_{max}$) only in cases in which target area sound determination processing cannot be performed with sufficient precision using the first determination processing (determination processing based on the all-band average power spectrum ratio) (for example, when the average power spectrum ratio U is small, such as in the case of unvoiced consonants).

Namely, the sound pick-up device 100A (area-sound determination section 9A) performs the more processing-heavy second determination processing that entails band division only in cases in which sufficiently precise target area sound determination processing is not possible with the first determination processing. This thereby enables target area sound determination processing to be performed efficiently.

(C) Third Exemplary Embodiment

Detailed explanation follows regarding a sound pick-up device, program, and method, and a determination device, program, and method, of a third exemplary embodiment of the present disclosure, with reference to the drawings.

(C-1) Configuration of Third Exemplary Embodiment

Figure 6:
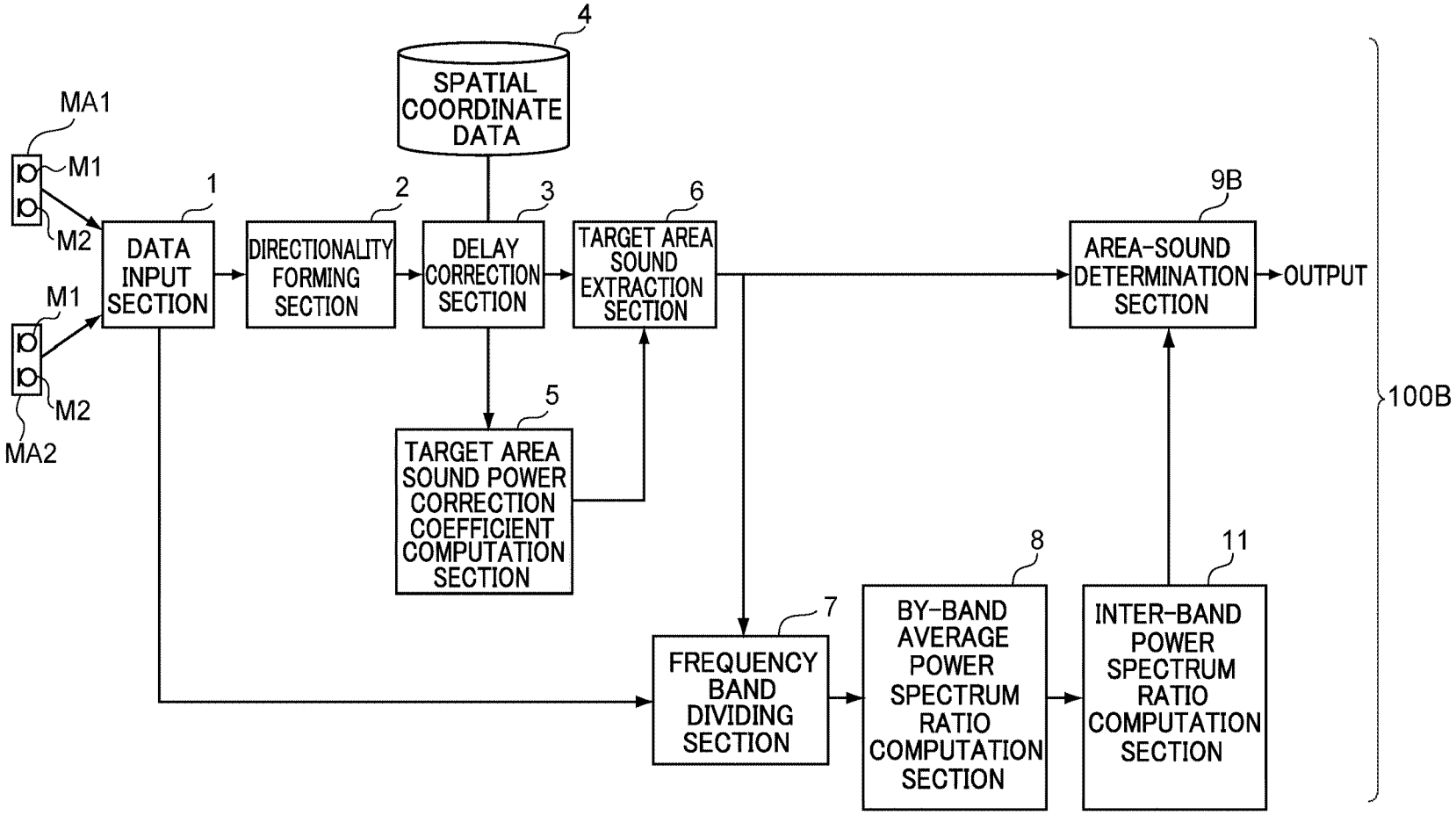
FIG. 6 is a block diagram illustrating functional configuration of a sound pick-up device (determination device) according to a third exemplary embodiment.

FIG. 6 is a block diagram illustrating functional configuration of a sound pick-up device 100B of the third exemplary embodiment. In FIG. 6, sections that are the same as or correspond to those in FIG. 1 described above are allocated the same reference numerals or corresponding reference numerals.

Explanation follows regarding differences between the sound pick-up device 100B of the third exemplary embodiment and the first exemplary embodiment.

The sound pick-up device 100B differs from the first exemplary embodiment in the points that an area-sound determination section 9B is provided instead of the area-sound determination section 9, and that an inter-band power spectrum ratio computation section 11 is additionally provided.

The inter-band power spectrum ratio computation section 11 computes the minimum value (referred to below as the "minimum average power spectrum ratio $U_{min}$") from out of the average power spectrum ratios for each divided band found by the by-band average power spectrum ratio computation section 8. The inter-band power spectrum ratio computation section 11 finds the ratio (referred to below as the "inter-band power spectrum ratio V") between the maximum average power spectrum ratio $U_{max}$ found by the by-band average power spectrum ratio computation section 8 (the maximum value out of the average power spectrum ratios R of each divided band) and the minimum average power spectrum ratio $U_{min}$.

The area-sound determination section 9B also differs from the first exemplary embodiment in the point that the target area sound is determined based on the inter-band power spectrum ratio V.

Note that in the second exemplary embodiment, the second determination processing may be substituted for determination processing employing the inter-band power spectrum ratio V.

(C-2) Operation of Third Exemplary Embodiment

Next, explanation follows regarding operation of the sound pick-up device 100B of the third exemplary embodiment configured as described above (a determination method and sound pick-up method according to an exemplary embodiment) with respect to differences to the first exemplary embodiment.

In the sound pick-up device 100B, the target area sound determination processing by the area-sound determination section 9B differs from that of the first exemplary embodiment. Explanation follows regarding the target area sound determination processing, focusing on the area-sound determination section 9B.

The inter-band power spectrum ratio computation section 11 finds the minimum average power spectrum ratio $U_{min}$ out of the average power spectrum ratios for each divided band found by the by-band average power spectrum ratio computation section 8, according to Equation (13).

Then the inter-band power spectrum ratio computation section 11 computes the inter-band power spectrum ratio V based on the maximum average power spectrum ratio $U_{max}$ and the minimum average power spectrum ratio $U_{min}$, according to Equation (14).

$$U_{min}=\min\overline{R_j} \tag{13}$$

$$V=U_{max}/U_{min} \tag{14}$$

For example, in cases in which the values of the average power spectrum ratios for each divided band ($R_1$ to $R_6$) give a result similar to that illustrated in FIG. 3, the maximum average power spectrum ratio $U_{max}$ is the value of the divided band $B_6$, and the value of the minimum average power spectrum ratio $U_{min}$ is the value of the divided band $B_3$.

The area-sound determination section 9B compares the inter-band power spectrum ratio V against a threshold value T4. In cases in which the inter-band power spectrum ratio V is greater than the threshold value T4 (in cases in which V>T4), the area-sound determination section 9B determines target area sound to be present. In cases in which the inter-band power spectrum ratio V is the threshold value T4 or lower (cases in which V≤T4), the area-sound determination section 9B determines target area sound not to be present.

The sound pick-up device 100B of the third exemplary embodiment detects target area sound based on the inter-band power spectrum ratio V, thereby enabling target area sound components with smaller power spectra to be detected.

(D) Modified Examples of the First to Third Exemplary Embodiments

The present disclosure is not limited to the exemplary embodiments described above, and modified examples such as those described below may also be implemented.

(D-1) In the first to the third exemplary embodiments described above, the area-sound determination section 9 (9A, 9B) may be equipped with a function (hangover function) such that target area sound is determined to be present regardless of the maximum average power spectrum ratio $U_{max}$ for a period of several seconds after the maximum average power spectrum ratio $U_{max}$ has exceeded the threshold value T1 by a specific amount or greater.

(D-2) In the sound pick-up devices (determination devices) of the first to the third exemplary embodiments described above, the average power spectrum ratios are computed for each divided band, and the maximum average power spectrum ratio $U_{max}$, this being the maximum value thereof, is employed in target area sound determination. However, instead of the average value of the power spectrum ratios for each divided band (average power spectrum ratio), a single representative value of the power spectrum ratios for each divided band may be acquired, and of these representative values (referred to below as "representative power spectrum ratios"), the maximum value (referred to below as the "maximum representative power spectrum ratio") may be employed instead of the maximum average power spectrum ratio $U_{max}$.

Namely, in the first to the third exemplary embodiments described above, the by-band average power spectrum ratio computation section 8 may acquire representative power spectrum ratios from each divided band, acquire the maximum value of the representative power spectrum ratios of the divided bands as the maximum representative power spectrum ratio, and employ this instead of the maximum average power spectrum ratio $U_{max}$ in target area sound determination. In the exemplary embodiments described above, these is no limitation to the position from which to acquire the representative power spectrum ratios (representative values) from each divided band. For example, the median value or the like may be acquired.

As described above, in target area sound determination, the first to the third exemplary embodiments described above employ the maximum value (for example the maximum average power spectrum ratio $U_{max}$ or the maximum representative power spectrum ratio) of the power spectrum ratios (for example, the average power spectrum ratio or representative power spectrum ratios) of the divided bands.

(E) Fourth Exemplary Embodiment

Detailed explanation follows regarding a sound pick-up device, program, and method of a fourth exemplary embodiment of the present disclosure, with reference to the drawings.

(E-1) Configuration of Fourth Exemplary Embodiment

Figure 7:
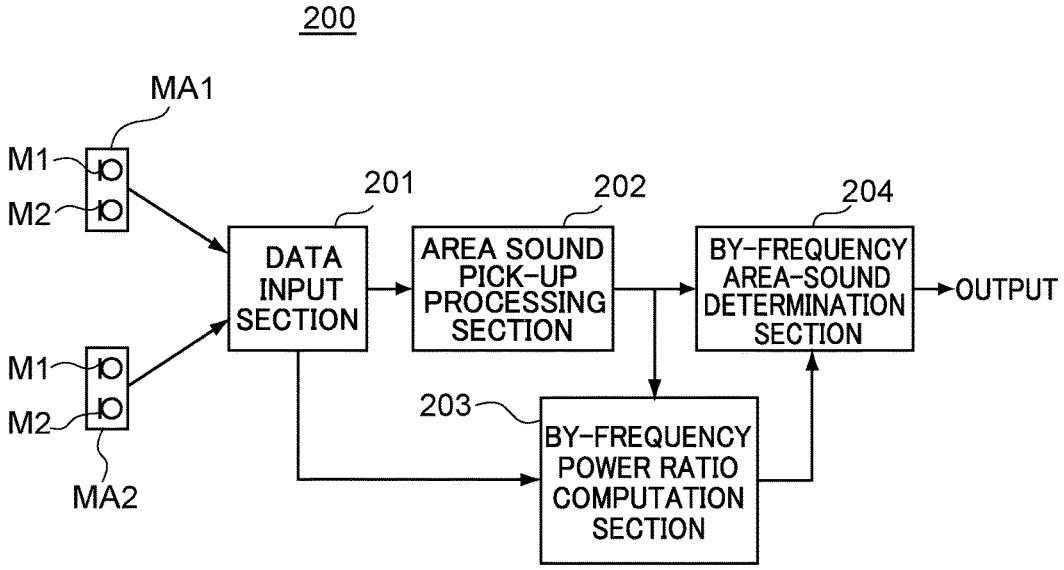
FIG. 7 is a block diagram illustrating functional configuration of a sound pick-up device according to a fourth exemplary embodiment.

FIG. 7 is a block diagram illustrating functional configuration of a sound pick-up device 200 of the fourth exemplary embodiment.

The sound pick-up device 200 employs two microphone arrays MA (MA1, MA2) to perform target area sound pick-up processing to pick up target area sound from a sound source in a target area.

The microphone arrays MA1, MA2 are disposed at any desired location in a space in which a target area is present. As illustrated in FIG. 13, for example, the microphone arrays MA1, MA2 may be positioned anywhere with respect to the target area as long as their directionality overlaps only in the target area. For example, the microphone arrays MA1, MA2 may be disposed facing each other across the target area. Each microphone array MA is configured by two or more microphones M, and each microphone M picks up acoustic signals. In the present exemplary embodiment, explanation is given in which two microphones M (M1, M2) that pick up acoustic signals are disposed in each microphone array MA. Namely, each microphone array MA is configured by a 2ch microphone array. Note that the number of the microphone arrays MA is not limited to two. In cases in which plural target areas are present, it is necessary to dispose a sufficient number of microphone arrays MA to cover all of the areas.

The sound pick-up device 200 includes a data input section 201, an area sound pick-up processing section 202, a by-frequency power ratio computation section 203, and a by-frequency area-sound determination section 204.

Figure 8:
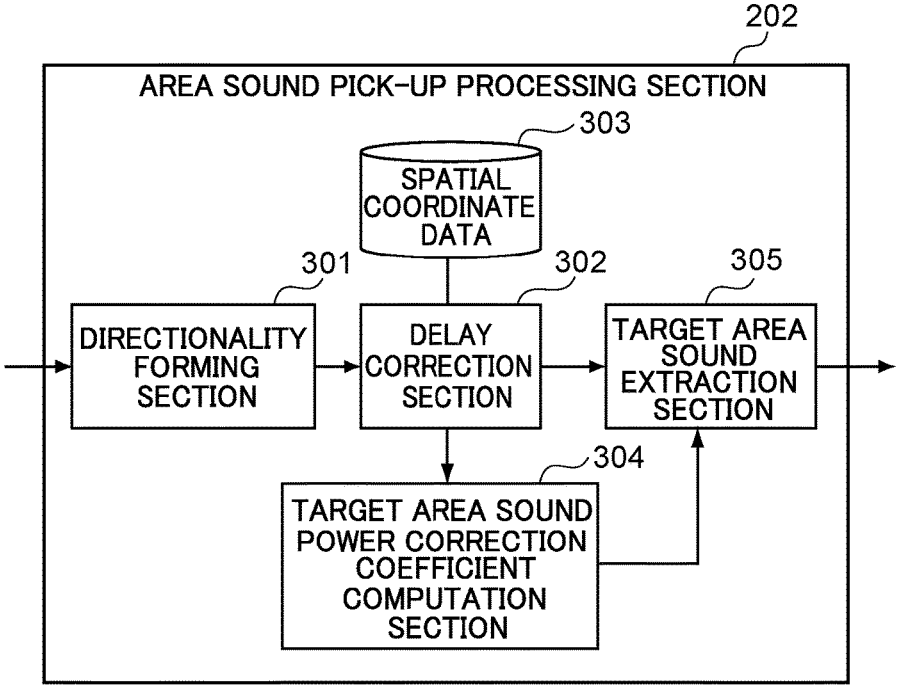
FIG. 8 is a block diagram illustrating functional configuration of an area sound pick-up processing section according to the fourth exemplary embodiment.

FIG. 8 is a block diagram illustrating an example of functional configuration of the area sound pick-up processing section 202.

In the example of the present exemplary embodiment, explanation is given in which the area sound pick-up processing section 202 includes a directionality forming section 301, a delay correction section 302, spatial coordinate data 303, a target area sound power correction coefficient computation section 304, and a target area sound extraction section 305.

Detailed explanation follows regarding processing of each functional block configuring the sound pick-up device 200.

The sound pick-up device 200 may be configured entirely by hardware (for example, dedicated chips or the like), or may be partially or entirely configured by software (programs). For example, the sound pick-up device 200 may be configured by installing programs (including a determination program and a sound pick-up program of the present exemplary embodiment) in a computer including a processor and memory.

(E-2) Operation of the Fourth Exemplary Embodiment

Next, explanation follows regarding operation of the sound pick-up device 200 of the fourth exemplary embodiment (a sound pick-up method according to an exemplary embodiment) configured as described above.

The data input section 201 converts acoustic signals picked up by the microphone arrays MA1, MA2 from analog signals into digital signals. The data input section 201 then performs conversion processing (for example, processing employing high-fast Fourier Transform or the like to convert from the time domain to the frequency domain) on the digital signals.

The area sound pick-up processing section 202 forms directionality for each microphone array based on input signals from the microphone arrays acquired from the data input section 201, and extracts components included in the directionality at the same time as each other as target area sound.

In the present exemplary embodiment, as an example, explanation is given in which the area sound pick-up processing by the area sound pick-up processing section 202 is implemented by the configuration illustrated in FIG. 8. However, configurations to extract target area sound using other methods may be applied.

Explanation follows regarding operation of each configuration element of the area sound pick-up processing section 202 illustrated in FIG. 8.

For each microphone array MA, the directionality forming section 301 extracts non-target area sound present outside of a target direction (for example, by extraction using a bidirectional filter), and subtracts the power spectrum of the extracted non-target area sound from the power spectrum of the input signal in order to acquire sound (BF output) formed with directionality in the target area direction. Specifically, for each microphone array MA, the directionality forming section 301 uses BF according to Equation (4) in order to acquire sound formed with directionality in the target area direction as the BF output.

The delay correction section 302 computes and corrects a delay arising due to differences in distance of the respective microphone arrays from the target area. The delay correction section 302 acquires the position of the target area and the positions of the microphone arrays from the spatial coordinate data 303, and computes the difference in the time taken for target area sound to arrive at the respective microphone arrays MA (MA1, MA2). Next, using the microphone array MA (MA1, MA2) disposed at the position furthest from the target area as a reference, the delay correction section 302 applies a delay as if the target area sound were to reach all of the microphone arrays MA (MA1, MA2) at the same time.

The spatial coordinate data 303 retains position information for all target areas, the microphone arrays MA (MA1, MA2), and the microphones M (M1, M2) configuring each of the microphone arrays MA (MA1, MA2).

The target area sound power correction coefficient computation section 304 follows Equation (5) or Equation (6) to compute a coefficient computation to make the power of a target area sound component included in the output from each BF the same.

The target area sound extraction section 305 performs SS according to Equation (7) for output data of each BF after correction using the correction coefficient computed by the target area sound power correction coefficient computation section 304 to extract noise present in the target area direction. The target area sound extraction section 305 then extracts target area sound by spectral subtracting the extracted noise from the output of each BF according to Equation (8).

For each frequency, the by-frequency power ratio computation section 203 employs the input signal $X_1$ supplied from the data input section 201 and the area sound output data $Z_1$ supplied from the area sound pick-up processing section 202 to compute a power ratio $|R_k|$ for each frequency. Specifically, the by-frequency power ratio computation section 203 computes a power ratio for each frequency based on Equation (15). Here, $|X_{1k}|$ is the power of a frequency k in the input signal $X_1$ (input signal from a first microphone M1) from the microphone array MA1, and $|Z_{1k}|$ is the power of the frequency k in the area sound output data. Moreover, m is a lower limit processing target frequency, and n is an upper limit processing target frequency.

$$|R_k| = \frac{|Z_{1k}|}{|X_{1k}|} \quad (k = m, \ldots, n) \tag{15}$$

The by-frequency area-sound determination section 204 compares the power ratio |R| computed by the by-frequency power ratio computation section 203 against a preset threshold value T5 for each frequency to determine an area sound component. Specifically, the by-frequency area-sound determination section 204 compares the power ratio |R| against the threshold value T5 for each frequency, and extracts components for which the power ratio |R| exceeds the threshold value T5.

In the by-frequency area-sound determination section 204, the threshold value T5 may be the same value for all frequencies, or different values may be applied for each frequency. For example, in the by-frequency area-sound determination section 204, values that decrease on progression from a low region toward a high region may be applied as T5. Moreover, for example, in the by-frequency area-sound determination section 204, a low region (for example at 100 Hz or lower) may be set with a higher value as T5 than outside of the low region (for example, at frequencies higher than 100 Hz).

In the present exemplary embodiment, explanation is given in which the by-frequency area-sound determination section 204 determines an area sound component to be present (a target area sound component to be present in the input signal $X_1$ and the area sound output data $Z_1$) for frequencies (frequency components) at which the power ratio |R| exceeds the threshold value T5 (|R|>T5).

The by-frequency area-sound determination section 204 outputs the area sound output data $Z_1$ supplied from the area sound pick-up processing section 202 as-is for frequencies (frequency components) in which an area sound component has been determined to be present, and outputs predetermined audio data (for example, preset silent audio data) without outputting the area sound output data $Z_1$ for frequencies in which an area sound component has been determined not to be present.

Note that instead of silence, the by-frequency area-sound determination section 204 may output the area sound output data $Z_1$ or the input signal $X_1$ with weakened gain for frequencies in which an area sound component has been determined not to be present.

In the sound pick-up device 200 of the present exemplary embodiment, a power ratio between the area sound output data and the input signal is found for each frequency (each frequency component), and determination is made as to whether or not that frequency is a target area sound component. Moreover, in the sound pick-up device 200 of the present exemplary embodiment, the power ratio of each frequency is compared against the preset threshold value T5, and frequencies at which the power ratio exceeds the threshold value T5 are determined to be target area sound components and the area sound output data for that frequency is output. Moreover, in the sound pick-up device 200 of the present exemplary embodiment, frequencies at which the power ratio is the threshold value T5 or lower are determined not to be target area sound components, and either nothing is output for those frequencies, or the area sound output data is output with reduced gain. Since the area sound output data has greater values for main components of the target area sound, in the sound pick-up device 200 of the present exemplary embodiment, components in which target area sound is present are output as they are. Moreover, in the sound pick-up device 200 of the present exemplary embodiment, although components with small values that have been determined not to be target area sound components are not output, this causes no ill-effects since they do not contribute to the target area sound. Even silent consonants that have low average power in all bands have peaks in their power spectrums. In the sound pick-up device 200 of the present exemplary embodiment, the power ratio is found for each frequency, and so the main components of silent consonants have large values and are thus determined to be target area sound components.

As described above, in the sound pick-up device 200 of the present exemplary embodiment, power ratios between the area sound output data and the input signals are found for each frequency component, the presence or absence of target area sound components is determined, and only frequency components determined to be target area sound components are output. This thereby enables loss of target area sound to be prevented even in high-noise environments.

(F) Fifth Exemplary Embodiment

Detailed explanation follows regarding a sound pick-up device, program, and method of a fifth exemplary embodiment of the present disclosure, with reference to the drawings.

(F-1) Configuration of Fifth Exemplary Embodiment

Figure 9:
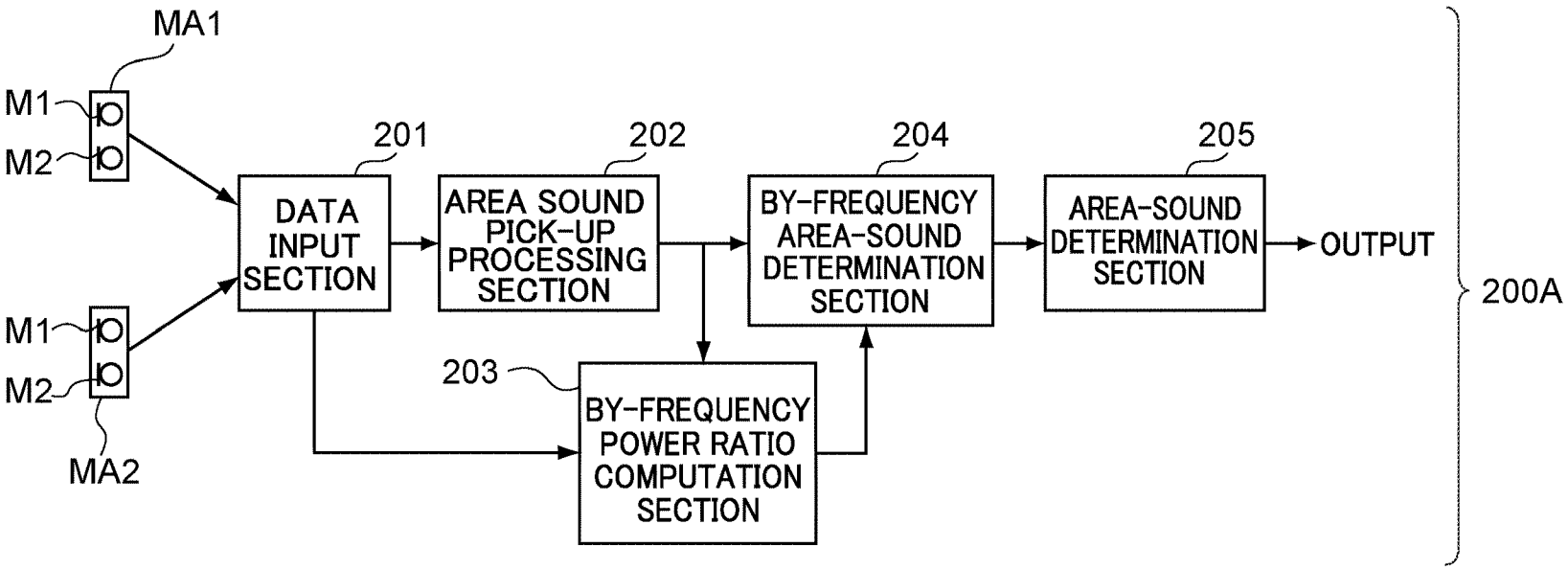
FIG. 9 is a block diagram illustrating functional configuration of a sound pick-up device according to a fifth exemplary embodiment.

FIG. 9 is a block diagram illustrating functional configuration of a sound pick-up device 200A of the fifth exemplary embodiment. In FIG. 9, sections that are the same as or correspond to those in FIG. 7 described above are allocated the same reference numerals or corresponding reference numerals.

Explanation follows regarding differences between the sound pick-up device 200A of the fifth exemplary embodiment and the fourth exemplary embodiment.

The sound pick-up device 200A differs from that of the fourth exemplary embodiment in the point that an area-sound determination section 205 is additionally provided at a later stage to the by-frequency area-sound determination section 204.

(F-2) Operation of Fifth Exemplary Embodiment

Next, explanation follows regarding differences between operation of the sound pick-up device 200A of the fifth exemplary embodiment configured as described above (a sound pick-up method according to an exemplary embodiment) and the fourth exemplary embodiment.

As described above, the sound pick-up device 200A differs from that of the fourth exemplary embodiment in the point that the area-sound determination section 205 is additionally provided. Explanation follows regarding target area sound determination processing, focusing on the area-sound determination section 205.

From the determination results for all frequencies of the by-frequency area-sound determination section 204, the area-sound determination section 205 determines whether or not target area sound is present in a segment (whether or not target area sound is present in the input signal $X_1$ and the area sound output data $Z_1$ in the segment). In cases in which target area sound has been determined to be present in the segment, all frequencies of the area sound output data $Z_1$ are output, and in cases in which target area sound is determined not to be present, predetermined data (for example silent data) is output for all frequencies.

Explanation follows regarding a specific example of the operation of the area-sound determination section 205.

First, from the determination results of the by-frequency area-sound determination section 204, the area-sound determination section 205 computes the proportion of frequencies determined to be target area sound components against frequencies determined not to be target area sound components.

For example, letting the number of frequencies determined to be target area sound components (frequencies for which the power ratio |R| exceeds the threshold value T5) be C1, and the number of frequencies determined not to be target area sound component (frequencies for which the power ratio |R| is the threshold value T5 or lower) be C2, then for a proportion P1 of frequencies determined to be target area sound components, P1=C1/(C1+C2), and for a proportion P2 of frequencies determined not to be target area sound components, P2=C2/(C1+C2). Note that the summed value of C1 and C2 is the total number of frequency components (for example, the number of binned frequencies).

In cases in which the proportion P2 of frequencies determined not to be target area sound components exceeds a threshold value T6 [%] (cases in which P2>T6, namely cases in which P1<(100 [%]−T6 [%])), the area-sound determination section 205 updates to a determination that all frequencies (all frequency components) are not target area sound components, and outputs silent data for all frequencies.

Moreover, in cases in which the proportion P2 of the frequencies determined not to be target area sound components is below the threshold value T6 (cases in which P2<T6, namely cases in which P1>(100%−T6[%])), the area-sound determination section 205 compares P2 against a threshold value T7. Note that T7 is a smaller value than T6 (T6>T7).

Moreover, in cases in which the proportion P2 of the frequencies determined not to be target area sound components is below T7 (cases in which P2<T7, namely cases in which P1>(100%−T7[%])), the area-sound determination section 205 updates to a determination that all frequencies are target area sound components, and outputs the area sound output data $Z_1$ for all frequencies.

Note that in cases in which P2 is not below T7 (cases in which T7<P2<T6, namely cases in which (100%−T7%)≥P1≥(100%−T6%)), the area-sound determination section 205 outputs each frequency according to the determination of the by-frequency area-sound determination section 204. Namely, in such cases, the area-sound determination section 205 outputs contents supplied from an earlier stage (the by-frequency area-sound determination section 204) as they are.

There is no limitation to the values of T6 and T7. However, for example, configuration may be made such that T6=80%, and T7=20%.

In the sound pick-up device 200A of the fifth exemplary embodiment, after the presence or absence of target area sound components has been determined for each frequency by the by-frequency area-sound determination section 204, the area-sound determination section 205 determines the final output based on the proportion of target area sound components across all frequencies. Moreover, in cases in which frequencies in which a target area sound component has been determined not to be present make up a specific proportion or greater of the total frequencies, the area-sound determination section 205 makes a new determination that target area sound components are not present at any frequency, and outputs silent data. Accordingly, in the sound pick-up device 200A, when target area sound is not present, even if there are frequencies in which target area sound has been incorrectly determined to be present, any effect resulting from such incorrect determination is suppressed.

(G) Sixth Exemplary Embodiment

Detailed explanation follows regarding a sound pick-up device, program, and method of a sixth exemplary embodiment of the present disclosure, with reference to the drawings.

(G-1) Configuration of Sixth Exemplary Embodiment

Figure 10:
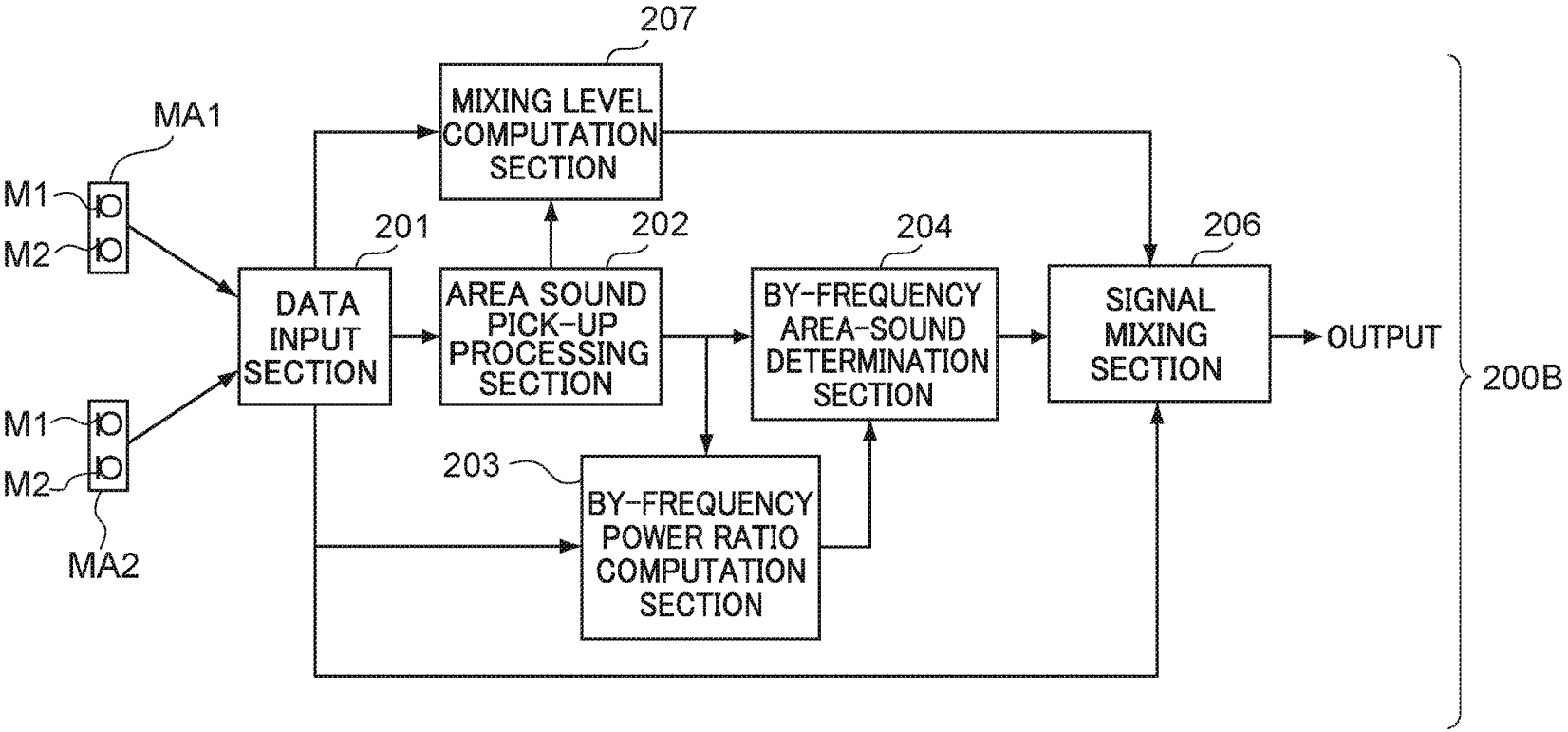
FIG. 10 is a block diagram illustrating functional configuration of a sound pick-up device according to a sixth exemplary embodiment.
Figure 11:
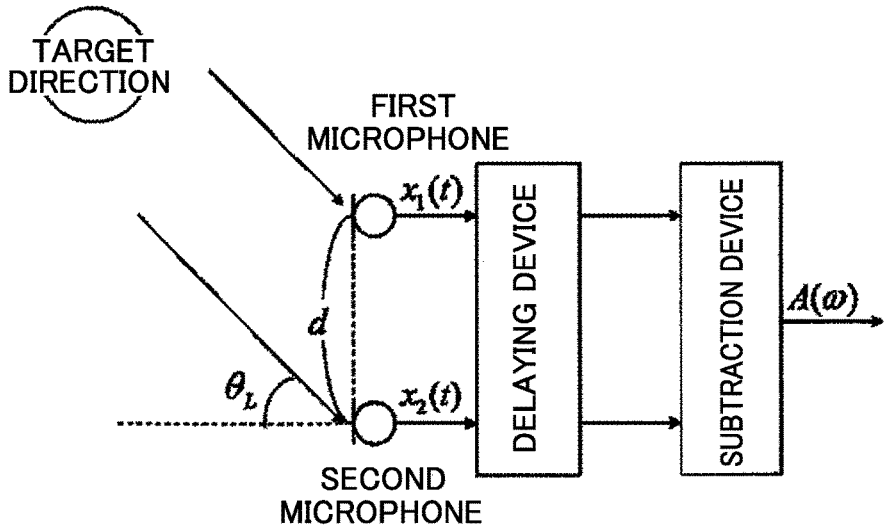
FIG. 11 is a block diagram illustrating configuration of a related subtraction-type BF in a case in which two microphones are present.
Figure 12A:
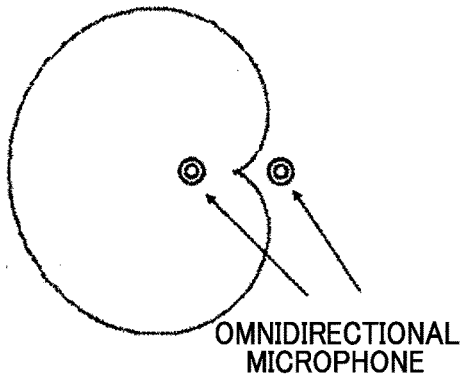
FIG. 12A is a diagram illustrating unidirectional characteristics formed by a related subtraction-type BF employing two microphones.
Figure 12B:
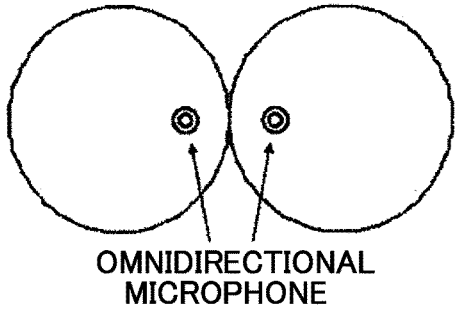
FIG. 12B is a diagram illustrating bidirectional characteristics formed by a related subtraction-type BF employing two microphones.

FIG. 10 is a block diagram illustrating functional configuration of a sound pick-up device 200B of the sixth exemplary embodiment. In FIG. 10, sections that are the same as or correspond to those in FIG. 7 described above are allocated the same reference numerals or corresponding reference numerals.

Explanation follows regarding differences between the sound pick-up device 200B of the sixth exemplary embodiment and the fourth exemplary embodiment.

The sound pick-up device 200B differs from the fourth exemplary embodiment in the point that a signal mixing section 206 and a mixing level computation section 207 are additionally provided. Note that in the sound pick-up device 200B, the signal mixing section 206 is inserted at a later stage than the by-frequency area-sound determination section 204.

(G-2) Operation of the Sixth Exemplary Embodiment

Next, explanation follows regarding differences between operation of the sound pick-up device 200B of the sixth exemplary embodiment configured as described above (a sound pick-up method according to an exemplary embodiment) and the fourth exemplary embodiment.

As described above, the sound pick-up device 200B differs from the fourth exemplary embodiment in the points that the signal mixing section 206 and the mixing level computation section 207 are additionally provided. Explanation follows regarding target area sound determination processing, focusing on the signal mixing section 206 and the mixing level computation section 207.

The mixing level computation section 207 determines the volume level of the input signal $X_1$ to be mixed with the output target area sound (output data) from the ratio between the area sound output data $Z_1$ and non-target area sound $N_1$ (this ratio is referred to below as the "SN ratio"). Note that a power spectrum $O_1$ of the non-target area sound $N_1$ may, for example, be extracted by spectral subtracting the area sound output data $Z_1$ from the input signal X1 according to Equation (3). Namely, $O_1$ may be expressed as in Equation (16). A mixing level coefficient $\delta_1$ to adjust a mixing volume level of the input signal $X_1$ is a variable proportional to the SN ratio $Z_1/O_1$ between the area sound output data $Z_1$ and the non-target area sound $N_1$, and is, for example, a value obtained by setting $X_1$ to −20 dB at a SN ratio of 0 dB. The mixing volume level obtained using $\delta_1$ is $\delta_1 X_1$. Instead of being a uniform value for all frequencies, $\delta_1$ may be weighted for each frequency, as $\delta_1\ \Phi_1$. Here, $\Phi_1$ may, for example, be set to values becoming smaller on progression from a low region toward a high region. In such cases, the mixing volume level is $\delta_1\Phi_1 X_1$.

$$O_1 = X_1 - Z_1 \tag{16}$$

For frequencies determined to be target area sound components by the by-frequency area-sound determination section 204, the signal mixing section 206 mixes input signals acquired by the data input section 201 to the area sound output data extracted by the area sound pick-up processing section 202 based on the level computed by the mixing level computation section 207. The final output $|W_{1k}|$ is mixed according to Equation (17) below. Here, k is a frequency that has been determined to be a target area sound component by the by-frequency area-sound determination section 204.

$$|W_{1k}| = |Z_{1k}| + \delta_1 |X_{1k}| \tag{17}$$

In the sound pick-up device 200B of the sixth exemplary embodiment, after the presence or absence of target area sound components has been determined for each frequency by the by-frequency area-sound determination section 204, the signal mixing section 206 and the mixing level computation section 207 adjust, add, and output gain of the input signal for only frequencies that have been determined to be target area sound components. Accordingly, the sound pick-up device 200B adds input signals only for target area sound components, thereby enabling the introduction of non-target area sound to be prevented, and enabling distortion of the target area sound to be corrected.

In other words, in the sound pick-up device 200B of the sixth exemplary embodiment, when mixing input signals in order to correct distortion in the target area sound, input signals are only added for frequencies that have been determined to be target area sound components. Even if non-target area sound is present in an input signal, the probability of target area sound components and non-target area sound components overlapping at each frequency is low. Accordingly, in the sound pick-up device 200B of the sixth exemplary embodiment, non-target area sound components are not added to the output (sound pick-up results), and only target area sound components are ultimately output.

Moreover, when mixing input signals in order to correct distortion in the target area sound, even if non-target area sound is present, in the sound pick-up device 200B of the sixth exemplary embodiment, only target area sound components are output, thereby enabling the sound quality to be improved while preserving area sound pick-up performance.

(H) Modified Examples of the Fourth to the Sixth Exemplary Embodiments

The present disclosure is not limited to the exemplary embodiments described above, and modified exemplary embodiments such as those given below may be implemented.

(H-1) The area-sound determination section 205 of the fourth exemplary embodiment may be equipped with a function (hangover function) such that target area sound is determined to be present in a component regardless of the values of the power ratio of the component for a period of several seconds after a component with a power ratio exceeding the threshold value T5 by a specific amount or greater was present.

(H-2) In the sound pick-up device 200A (area-sound determination section 205) of the fifth exemplary embodiment, configuration may be made such that instead of all frequencies (the entire band), all frequencies (the entire band) are divided into plural bands (these bands that have been divided are also referred to below as "divided bands"), and power ratios are computed for each component in each divided band. The presence or absence of target area sound is determined for each divided band, and the presence or absence of output (whether or not to add to sound pick-up results) may be determined for each divided band.

Specifically, for example, in cases in which a proportion of frequencies determined not to be target area sound components in a given divided band (frequencies having a power ratio exceeding the threshold value T5) exceeds the threshold value T6, the area-sound determination section 205 may update to a determination that target area sound components are not present in the divided band overall, and output silent data.

Moreover, for example, in cases in which the proportion of frequencies determined not to be target area sound components in a given divided band is lower than the threshold value T6, the area-sound determination section 205 compares this proportion against the threshold value T7 (T6>T7). Then, in cases in which this proportion is less than the threshold value T7 in the divided band, the area-sound determination section 205 may update to a determination that target area sound components are present in this divided band overall, and output area sound output data of the overall divided band.

Moreover, in cases in which the proportion of the divided band is lower than T7, the area-sound determination section 205 may output according to the determination results of the by-frequency area-sound determination section 204 (determination results for each frequency) (output the output results of the by-frequency area-sound determination section 204 for the divided band as they are).

Moreover, in cases in which a divided band includes even a single frequency determined to be a target area sound component, the area-sound determination section 205 may update to a determination that a target area sound component is present in the overall divided band, and output area sound output data for all frequencies within the divided band.

(H-3) The fifth exemplary embodiment and the sixth exemplary embodiment may be combined together. Specifically, the sound pick-up device 200A may be additionally provided with the signal mixing section 206 and the mixing level computation section 207. In such cases, the signal mixing section 206 may be inserted at a later stage than the area-sound determination section 205.

What is claimed is:

1. A sound pick-up device comprising:

a directionality forming unit that forms directionality in a target area direction from an input signal using a beam former;

a non-target area sound extraction unit that extracts non-target area sound present in the target area direction designated by the directionality formed by the directionality forming unit;

a target area sound extraction unit that outputs extracted sound, the extracted sound obtained by subtracting the non-target area sound present in the target area direction from output of the beam former;

a band dividing unit that divides each of the input signal and the extracted sound into a plurality of bands;

a power spectrum ratio computation unit that computes a power spectrum ratio between the input signal and the extracted sound for each divided band divided by the band dividing unit;

a determination unit that determines whether or not target area sound is present in the input signal by employing the power spectrum ratio for each divided band computed by the power spectrum ratio computation unit; and an output unit that outputs the extracted sound as a sound pick-up result in cases in which the determination unit has determined target area sound to be present.

2. The sound pick-up device of claim 1, wherein the determination unit determines whether or not target area sound is present in the input signal according to a comparison result between a maximum value of the power spectrum ratios for each divided band computed by the power spectrum ratio computation unit and a first threshold value.

3. The sound pick-up device of claim 1, further comprising an all-band average power spectrum ratio computation unit that computes all-band average power spectrum ratio, the all-band average power spectrum ratio being an average power spectrum ratio between the input signal and the extracted sound for all bands, wherein:

the determination unit performs first determination processing to determine whether or not target area sound is present in the input signal based on the all-band average power spectrum ratio;

the band dividing unit divides each of the input signal and the extracted sound into a plurality of bands in cases in which the first determination processing is unable to determine whether or not target area sound is present in the input signal;

the power spectrum ratio computation unit computes a power spectrum ratio between the input signal and the extracted sound for each band in cases in which the first determination processing is unable to determine whether or not target area sound is present in the input signal; and the determination unit performs second determination processing to determine whether or not target area sound is present in the input signal from the power spectrum ratio computed by the power spectrum ratio computation unit in cases in which the first determination processing is unable to determine whether or not target area sound is present in the input signal.

4. The sound pick-up device of claim 3, wherein:

in the first determination processing, the determination unit performs the followings:

(i) determining target area sound to be present in the input signal in cases in which the all-band average power spectrum ratio exceeds a second threshold value, (ii) determining target area sound not to be present in the input signal in cases in which the all-band average power spectrum ratio is not larger than a third threshold value that is smaller than the second threshold value, and (iii) obtaining a result of being unable to determine whether or not target area sound is present in the input signal in cases in which the all-band average power spectrum ratio exceeds the third threshold value and is not larger than the second threshold value.

5. The sound pick-up device of claim 3, wherein in the second determination processing, the determination unit determines whether or not target area sound is present in the input signal according to a comparison result of a maximum value of the power spectrum ratios for each divided band computed by the power spectrum ratio computation unit against a first threshold value.

6. The sound pick-up device of claim 1, wherein the determination unit determines whether or not target area sound is present in the input signal according to a comparison result of an inter-band power spectrum ratio against a fourth threshold value, the inter-band power spectrum ratio expressed as a ratio between a maximum value and a minimum value of the power spectrum ratios for each divided band.

7. A non-transitory computer-readable recording medium storing a sound pick-up program that causes a computer to execute processing, the processing comprising:

forming directionality in a target area direction from an input signal using a beam former;

extracting non-target area sound present in the target area direction designated by the formed directionality;

outputting extracted sound, the extracted sound obtained by subtracting the extracted non-target area sound present in the target area direction from output of the beam former;

dividing each of the input signal and the extracted sound into a plurality of bands;

computing a power spectrum ratio between the input signal and the extracted sound for each divided band;

determining whether or not target area sound is present in the input signal by employing the power spectrum ratio computed for each divided band; and outputting the extracted sound as a sound pick-up result in cases in which target area sound has been determined to be present.

8. A sound pick-up method comprising:

forming directionality in a target area direction from an input signal using a beam former;

extracting non-target area sound present in the target area direction designated by the formed directionality;

outputting extracted sound, the extracted sound obtained by subtracting the extracted non-target area sound present in the target area direction from output of the beam former;

dividing each of the input signal and the extracted sound into a plurality of bands;

computing a power spectrum ratio between the input signal and the extracted sound for each divided band;

determining whether or not target area sound is present in the input signal by employing the power spectrum ratio computed for each divided band; and outputting the extracted sound as a sound pick-up result in cases in which target area sound has been determined to be present.

9. A sound pick-up device comprising:

a directionality forming unit that forms directionality in a target area direction from an input signal using a beam former;

a non-target area sound extraction unit that extracts non-target area sound present in the target area direction designated by the directionality formed by the directionality forming unit;

a target area sound extraction unit that outputs extracted sound, the extracted sound obtained by subtracting the non-target area sound present in the target area direction from output of the beam former;

a power spectrum ratio computation unit that computes a power spectrum ratio between the input signal and the extracted sound for each frequency component;

a determination unit that determines whether or not target area sound is present in each frequency component by employing the power spectrum ratio computed by the power spectrum ratio computation unit; and an output unit that outputs a frequency component of the extracted sound for a frequency component in which the determination unit has determined target area sound to be present.

10. The sound pick-up device of claim 9, wherein for each frequency component, the determination unit determines whether or not target area sound is present based on a comparison result between the power spectrum ratio computed by the power spectrum ratio computation unit and a first threshold value.

11. The sound pick-up device of claim 9, wherein the output unit does not output the extracted sound for any frequency components, in cases in which a proportion of frequency components, for which the determination unit has determined that target area sound is not present in the input signal, exceeds a second threshold value.

12. The sound pick-up device of claim 11, wherein the output unit outputs extracted sound for all frequency components, in cases in which the proportion of frequency components, for which the determination unit has determined that target area sound is not present in the input signal, is less than a third threshold value that is smaller than the second threshold value.

13. The sound pick-up device of claim 9, further comprising a mixing level computation unit that computes a volume level of the input signal to be mixed into output sound based on a ratio between the non-target area sound extracted based on the input signal and the extracted sound, and the extracted sound wherein:

for a frequency component in which the determination unit has determined target area sound to be present, the output unit mixes the input signal that has been gain-adjusted based on a volume level computed by the mixing level computation unit and outputs the gain-adjusted input signal.

14. A non-transitory computer-readable recording medium storing a sound pick-up program that causes a computer to execute processing, the processing comprising:

forming directionality in a target area direction from an input signal using a beam former;

extracting non-target area sound present in the target area direction designated by the formed directionality;

outputting extracted sound, the extracted sound obtained by subtracting the extracted non-target area sound present in the target area direction from output of the beam former;

computing a power spectrum ratio between the input signal and the extracted sound for each frequency component;

determining whether or not target area sound is present for each frequency component by employing the computed power spectrum ratios; and outputting a frequency component of the extracted sound for a frequency component in which target area sound has been determined to be present.

15. A sound pick-up method comprising:

forming directionality in a target area direction from an input signal using a beam former;

extracting non-target area sound present in the target area direction designated by the formed directionality;

outputting extracted sound, the extracted sound obtained by subtracting the extracted non-target area sound present in the target area direction from output of the beam former;

computing a power spectrum ratio between the input signal and the extracted sound for each frequency component;

determining whether or not target area sound is present for each frequency component by employing the computed power spectrum ratios; and outputting a frequency component of the extracted sound for a frequency component in which target area sound has been determined to be present.

* * * * *